US012566003B2

(12) United States Patent
Park et al.

(10) Patent No.: US 12,566,003 B2
(45) Date of Patent: Mar. 3, 2026

(54) OUTDOOR UNIT OF AIR CONDITIONER

(71) Applicant: SAMSUNG ELECTRONICS CO., LTD., Suwon-si (KR)

(72) Inventors: Hyejeong Park, Suwon-si (KR); Keunjeong Jang, Suwon-si (KR); Eunsung Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 125 days.

(21) Appl. No.: 18/229,866

(22) Filed: Aug. 3, 2023

(65) Prior Publication Data

US 2024/0117975 A1 Apr. 11, 2024

Related U.S. Application Data

(63) Continuation of application No. PCT/KR2023/009633, filed on Jul. 7, 2023.

(30) Foreign Application Priority Data

Oct. 7, 2022 (KR) ..... 10-2022-0129080

(51) Int. Cl.
*F24F 1/38* (2011.01)
*F24F 1/56* (2011.01)

(52) U.S. Cl.
CPC . *F24F 1/38* (2013.01); *F24F 1/56* (2013.01)

(58) Field of Classification Search
CPC .. F24F 1/38; F24F 1/56; F04D 29/325; F04D 29/326; F04D 29/327; F04D 29/328; F04D 29/329
See application file for complete search history.

(56) References Cited

U.S. PATENT DOCUMENTS 9,416,982 B2 8/2016 Kim et al.
10,900,360 B2 1/2021 Teramoto
(Continued)

FOREIGN PATENT DOCUMENTS

CN 212339418 U 1/2021
JP 7-324774 12/1995
(Continued)

OTHER PUBLICATIONS

Pdf is translation of foreign reference KR-20180056741-A (Year: 2018).*
(Continued)

*Primary Examiner* — Len Tran
*Assistant Examiner* — Kamran Tavakoldavani
(74) *Attorney, Agent, or Firm* — STAAS & HALSEY LLP

(57) ABSTRACT

An outdoor unit of an air conditioner, including a housing including an inlet and an outlet, wherein a flow path is formed between the inlet and the outlet inside the housing; a heat exchanger positioned on the flow path inside the housing; and a blower fan inside the housing between the inlet and the heat exchanger, and configured to flow air along the flow path, from the inlet, through the heat exchanger, and toward the outlet, wherein the blower fan includes a hub configured to be rotatable, and a plurality of blades extending from the hub and arranged along a circumference of the hub, each blade among the plurality of blades includes a leading edge at a side of a rotation direction of the hub, a trailing edge opposite to the leading edge, and a blade surface between the leading edge and the trailing edge and inclined toward the inlet from the trailing edge to the leading edge.

17 Claims, 11 Drawing Sheets

(56) References Cited

U.S. PATENT DOCUMENTS

| | | | | |
|---|---|---|---|---|
| 2010/0319380 | A1* | 12/2010 | Mochizuki | F24F 13/20 62/426 |
| 2011/0174011 | A1 | 7/2011 | Kim et al. | |
| 2020/0378628 | A1* | 12/2020 | Tomioka | F24F 13/20 |
| 2022/0349409 | A1* | 11/2022 | Tyni | F04D 29/384 |

FOREIGN PATENT DOCUMENTS

| | | | | |
|---|---|---|---|---|
| JP | 2008-202870 | | 9/2008 | |
| JP | 2011-33337 | | 2/2011 | |
| JP | 2011-236860 | | 11/2011 | |
| JP | 2014-5975 | | 1/2014 | |
| KR | 10-2004-0043442 | | 5/2004 | |
| KR | 10-2004-0050784 | | 6/2004 | |
| KR | 20040050784 | A * | 6/2004 | |
| KR | 10-0567804 | | 4/2006 | |
| KR | 10-0615786 | | 8/2006 | |
| KR | 10-0772236 | | 11/2007 | |
| KR | 10-2011-0085646 | | 7/2011 | |
| KR | 10-1583080 | | 1/2016 | |
| KR | 20180056741 | A * | 5/2018 | F24F 1/38 |
| KR | 10-2019-0139054 | | 12/2019 | |
| KR | 10-2062603 | | 1/2020 | |

OTHER PUBLICATIONS

Pdf is translation of foreign reference KR-20040050784-A (Year: 2004).*

International Search Report, PCT/ISA/210, dated Oct. 23, 2023, in International Application No. PCT/KR2023/009633.

Written Opinion, PCT/ISA/237, dated Oct. 23, 2023, in International Application No. PCT/KR2023/009633.

* cited by examiner

OUTDOOR UNIT OF AIR CONDITIONER

CROSS-REFERENCE TO RELATED APPLICATION

This application is a continuation application, under 35 U.S.C. § 111(a), of international application No. PCT/KR2023/009633, filed on Jul. 7, 2023, which claims priority to Korean Patent Application No. 10-2022-0129080, filed on Oct. 7, 2022, in the Korean Intellectual Property Office, the disclosures of which are incorporated by reference herein in their entireties.

BACKGROUND

1. Field

The disclosure relates to an outdoor unit of an air conditioner.

2. Description of the Related Art

An air conditioner is an apparatus for adjusting temperature, humidity, air current, distribution, etc., to suitable conditions for human activities by using a cooling cycle. Main components constituting the cooling cycle include a compressor, a condenser, an evaporator, a blower fan, etc.

Air conditioners are classified into a split type air conditioner in which an indoor unit is separated from an outdoor unit, and a window type air conditioner in which an indoor unit and an outdoor unit are installed together in a cabinet.

The outdoor unit of the split type air conditioner includes an outdoor heat exchanger for performing heat exchange with outdoor air, a compressor for compressing refrigerants, an expansion valve unit for decompressing refrigerants, and a blower fan for generating a flow of air. Also, the outdoor unit of the air conditioner includes a housing accommodating the outdoor heat exchanger, the expansion valve unit, the compressor, and the blower fan.

According to a rotation of the blower fan of the outdoor unit, outside air of the outdoor unit is sucked into the inside of the outdoor unit, and the air sucked into the inside of the outdoor unit is discharged to the outside of the outdoor unit by passing through the heat exchanger.

SUMMARY

Aspects of embodiments of the disclosure will be set forth in part in the description which follows and, in part, will be apparent from the description, or may be learned by practice of the presented embodiments.

According to an embodiment of the disclosure, an outdoor unit of an air conditioner includes a housing including an inlet and an outlet, wherein a flow path is formed between the inlet and the outlet inside the housing; a heat exchanger inside the housing; and a blower fan inside the housing between the inlet and the heat exchanger, and configured to flow air along the flow path, from the inlet, through the heat exchanger, and toward the outlet, wherein the blower fan includes a hub configured to be rotatable, and a plurality of blades extending from the hub and arranged along a circumference of the hub, each blade among the plurality of blades includes a leading edge at a side of a rotation direction of the hub, a trailing edge opposite to the leading edge, and a blade surface between the leading edge and the trailing edge and inclined toward the inlet from the trailing edge to the leading edge.

According to an embodiment of the disclosure, the leading edge may include a first end connected to the hub, and a second end opposite to the first end, and the second end may be closer than the first end to the inlet.

According to an embodiment of the disclosure, the heat exchanger may be positioned adjacent to the outlet, and each blade among the plurality of blades may be positioned such that the trailing edge is closer than the leading edge to at least one portion of the heat exchanger.

According to an embodiment of the disclosure, the outdoor unit may further include a guide positioned along a circumferential direction of the plurality of blades and configured to guide air flowing along the flow path, and the guide may cover the trailing edge of each blade among the plurality of blades from outside in a radial direction of the hub.

According to an embodiment of the disclosure, the guide may extend from the inlet toward the heat exchanger, up to the trailing edge of each blade among the plurality of blades.

According to an embodiment of the disclosure, the guide may include an inlet end through which air enters the guide, an outlet end through which air is discharged from the guide, and a bell mouth extending from the inlet end toward the outlet end, and the bell mouth may be reduced in width from the inlet end toward the outlet end.

According to an embodiment of the disclosure, the bell mouth may cover an outer end of the trailing edge of each blade among the plurality of blades in the radial direction of the hub.

According to an embodiment of the disclosure, the guide may include a diffuser extending from the outlet end toward the bell mouth, and the diffuser may increase in width toward the outlet end.

According to an embodiment of the disclosure, the heat exchanger may include a first portion facing the outlet end, and a second portion bent from one end of the first portion and extending in a longitudinal direction of the guide, and the diffuser may be configured to move at least a portion of air flowing along the outlet end toward the second portion.

According to an embodiment of the disclosure, the blower fan may include a rotating shaft coupled to the hub, and the inlet end and the outlet end may be disposed to face each other in a longitudinal direction of the rotating shaft.

According to an embodiment of the disclosure, the heat exchanger may include a first portion facing the outlet end, and a second portion bent from one end of the first portion and extending in a direction toward the inlet, and the outdoor unit may further include a slewing guide configured to cause at least a portion of air discharged from the outlet end to flow to the second portion by slewing.

According to an embodiment of the disclosure, the blade surface may include an upstream surface facing an upstream direction of the flow path, and a downstream surface being opposite to the upstream surface and facing a downstream direction of the flow path, the upstream surface may include a convex surface that is convex toward the upstream direction of the flow path, and the downstream surface may include a concave surface that is concave toward the upstream direction of the flow path.

According to an embodiment of the disclosure, the concave surface may extend in a direction from the trailing edge of the blade toward the leading edge, and the concave surface may be formed with a smaller inclination at the trailing edge than at the leading edge with respect to a direction of the flow path.

According to an embodiment of the disclosure, an angle of inclination of an extension direction of the leading edge with respect to a radial direction of the hub may be greater than an angle of inclination of an extension direction of the trailing edge with respect to the radial direction of the hub.

According to an embodiment of the disclosure, an extension length of the leading edge from the hub may be longer than an extension length of the trailing edge from the hub.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
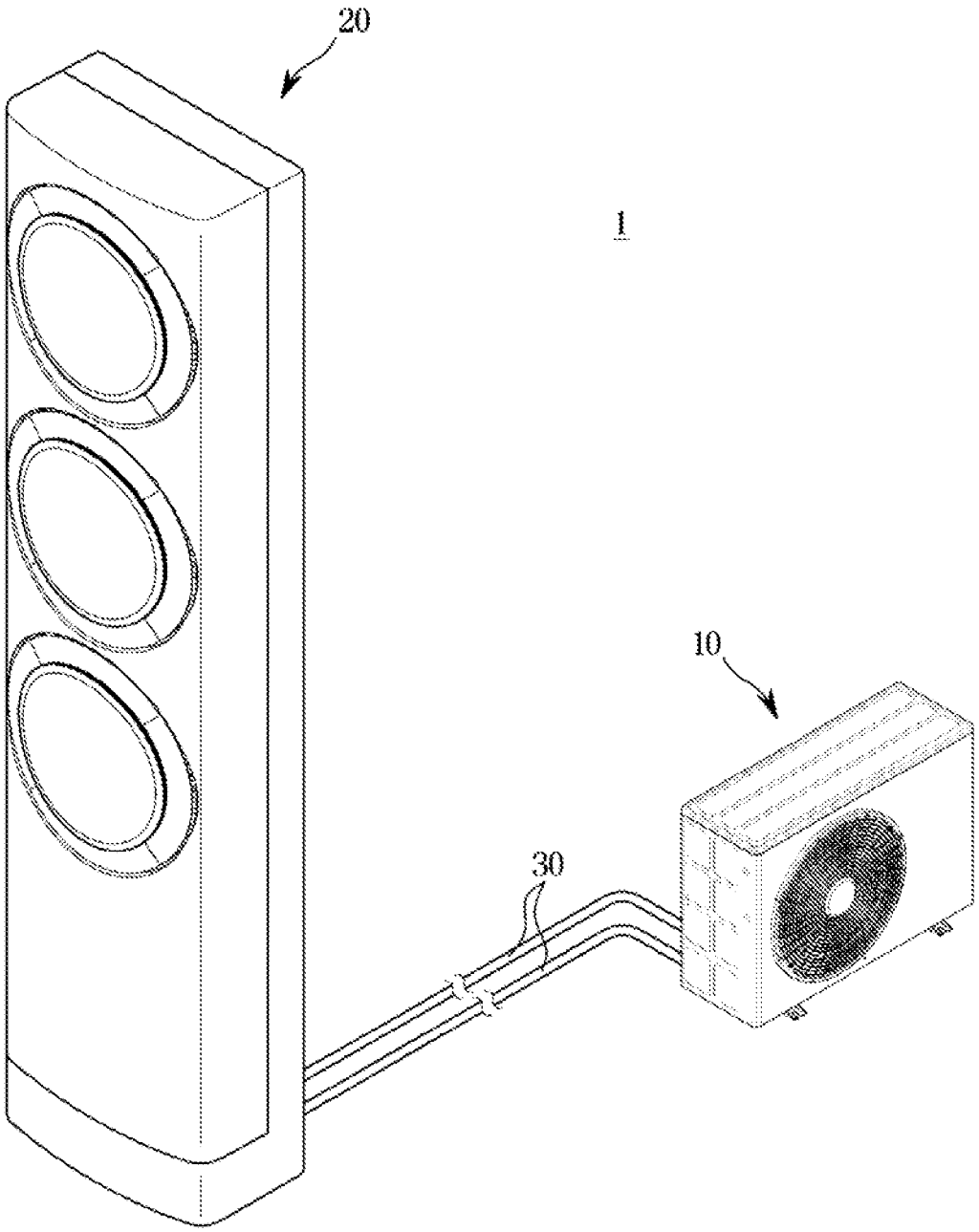
FIG. 1 shows an air conditioner according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

In the following description, the terms "upper direction", lower direction", "front direction", "rear direction", etc. are defined based on the drawings, and the shapes and positions of the corresponding components are not limited by the terms. For example, the following terms "upper direction" and "lower direction" may indicate upper and lower directions in a Z direction based on FIG. 2. The following terms "front direction" and "rear direction" may indicate front and rear directions in an X direction based on FIG. 2. The following term "left-right direction" may indicate a Y direction based on FIG. 2.

Embodiments of the disclosure may provide an outdoor unit of an air conditioner with a structure for improving a flow direction of air for heat exchange. Embodiments of the disclosure may provide an outdoor unit of an air conditioner with an improved structure for receiving air from a front direction of the outdoor unit. Embodiments of the disclosure may provide an outdoor unit of an air conditioner with an improved structure for enhancing heat-exchange efficiency of a heat exchanger. Technical problems to be overcome by embodiments of the disclosure are not limited to the technical problems described, and other technical problems overcome but not mentioned will be clearly understood by those skilled in the art to which the disclosure belongs from the following description.

Hereinafter, embodiments of the disclosure will be described in detail with reference to the accompanying drawings.

FIG. 1 shows an air conditioner according to an embodiment of the disclosure.

Referring to FIG. 1, an air conditioner 1 according to an embodiment of the disclosure may include an indoor unit 20 positioned in an indoor space, and an outdoor unit 10 positioned in an outdoor space.

The air conditioner 1 may absorb heat inside an air-conditioning space to be air-conditioned and emit heat outside the air-conditioning space to cool the air-conditioning space. Also, the air conditioner 1 may absorb heat outside the air-conditioning space and emit heat to the air-conditioning space to heat the air-conditioning space.

The outdoor unit 10 may exchange heat with outdoor air outside the air-conditioning space. The outdoor unit 10 may perform heat exchange between refrigerants and outdoor air by using a phase change (for example, evaporation or condensation) of refrigerants. For example, the outdoor unit 10 may emit heat of refrigerants to outdoor air by using condensation of the refrigerants. Also, the outdoor unit 10 may absorb heat of outdoor air into the refrigerants by using evaporation of the refrigerants.

In FIG. 1, a single outdoor unit 10 is shown, and a number of the outdoor unit 10 is not limited to that shown in FIG. 1. For example, the air conditioner 1 may include a plurality of outdoor units.

The outdoor unit 10 may include an outdoor heat exchanger 11 (see FIG. 3) for performing heat exchange with outdoor air, and a compressor 12 (see FIG. 3) for compressing a refrigerant gas.

A detailed description about a configuration of the outdoor unit 10 will be given below.

The indoor unit 20 may exchange heat with indoor air inside the air-conditioning space. The indoor unit 20 may perform heat exchange between refrigerants and indoor air by using a phase change (for example, evaporation or condensation) of refrigerants. For example, the indoor unit 20 may cool the air-conditioning space by absorbing heat of indoor air into refrigerants through evaporation of the refrigerants. Also, the indoor unit 20 may heat the air-conditioning space by emitting heat of refrigerants to indoor air through condensation of the refrigerants.

The indoor unit 20 may include an indoor heat exchanger for performing heat exchange with indoor air, an indoor blower fan for sucking indoor air and blowing the indoor air to pass the indoor air through the indoor heat exchanger, and an expansion valve unit for decompressing refrigerants and expanding the refrigerants.

In FIG. 1, a single indoor unit 20 is shown, however, a number of the indoor unit 20 is not limited to that shown in FIG. 1. For example, the air conditioner 1 may include a plurality of indoor units. The plurality of indoor units may be installed in a plurality of different air-conditioning spaces, respectively.

As such, the air conditioner 1 may perform heat exchange between refrigerants and outdoor air outside an air-conditioning space and heat exchange between refrigerants and indoor air inside the air-conditioning space.

In this case, the air conditioner 1 may include a refrigerant pipe 30 for transferring refrigerants between the indoor unit 20 and the outdoor unit 10, to move heat between the outside and inside of the air-conditioning space. The refrigerant pipe 30 may move the refrigerants between the outside of the air-conditioning space and the inside of the air-conditioning space.

The indoor unit 20 may be connected to the outdoor unit 10 through the refrigerant pipe 30 for transferring refrigerants. Also, the indoor unit 20 may be connected to the outdoor unit 10 through a wire for transmitting power and electrical signals, although not shown in the drawings.

The above-described air conditioner 1 may be only an example of an air conditioner to which an outdoor unit of an air conditioner, according to a concept of the disclosure, may be applied, and a concept of the disclosure is not limited to the air conditioner 1. An air conditioner to which the outdoor unit of the air conditioner, according to a concept of the disclosure, may be applied, and components, such as an indoor unit, a refrigerant pipe, etc., included in the air conditioner, may be various.

Hereinafter, the outdoor unit 10 of the air conditioner 1 according to an embodiment of the disclosure will be described in detail with reference to FIGS. 2 to 11. Also, hereinafter, the outdoor heat exchanger 11 included in the outdoor unit 10 will be referred to as a heat exchanger 11 for convenience of description.

Figure 2:
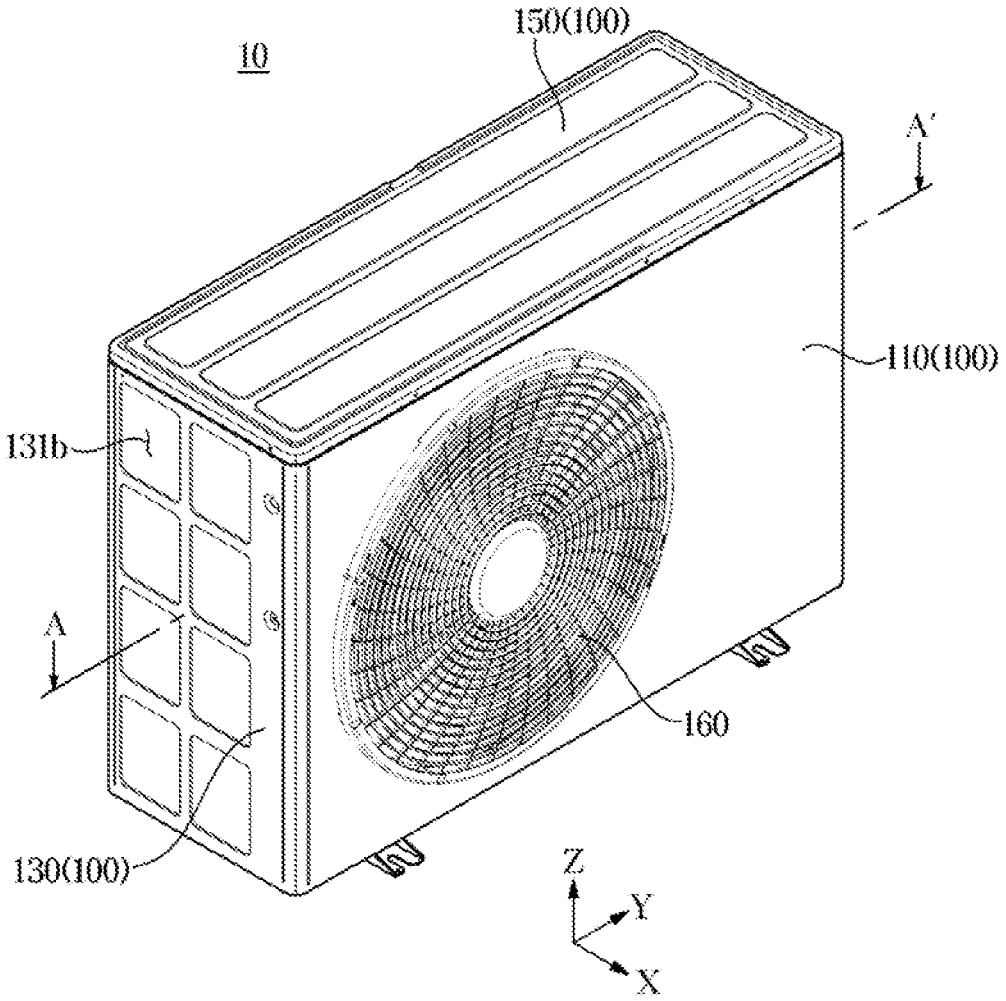
FIG. 2 shows an outdoor unit of an air conditioner according to an embodiment of the disclosure.
Figure 3:
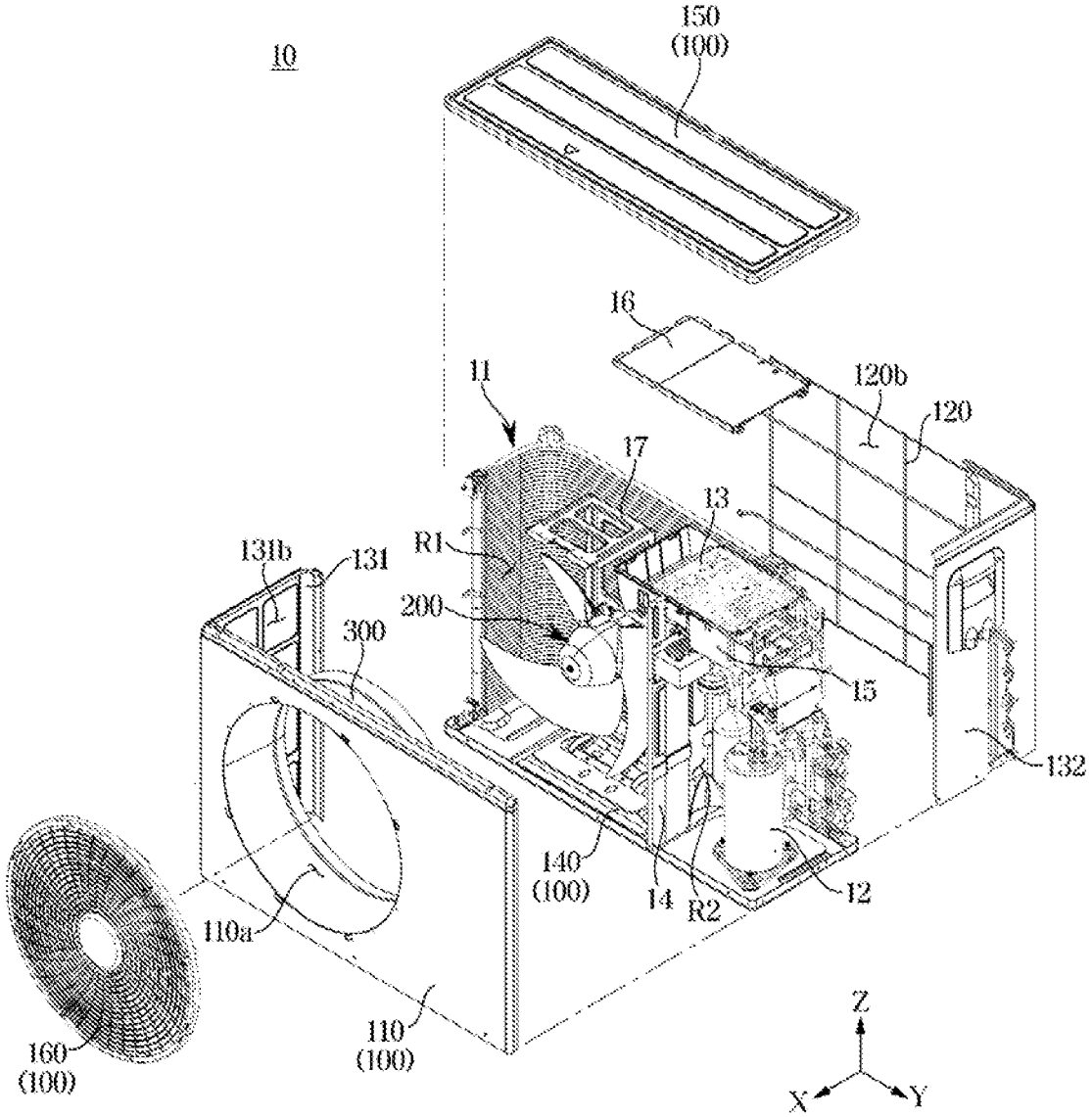
FIG. 3 is an exploded view of an outdoor unit of an air conditioner according to an embodiment of the disclosure.
Figure 4:
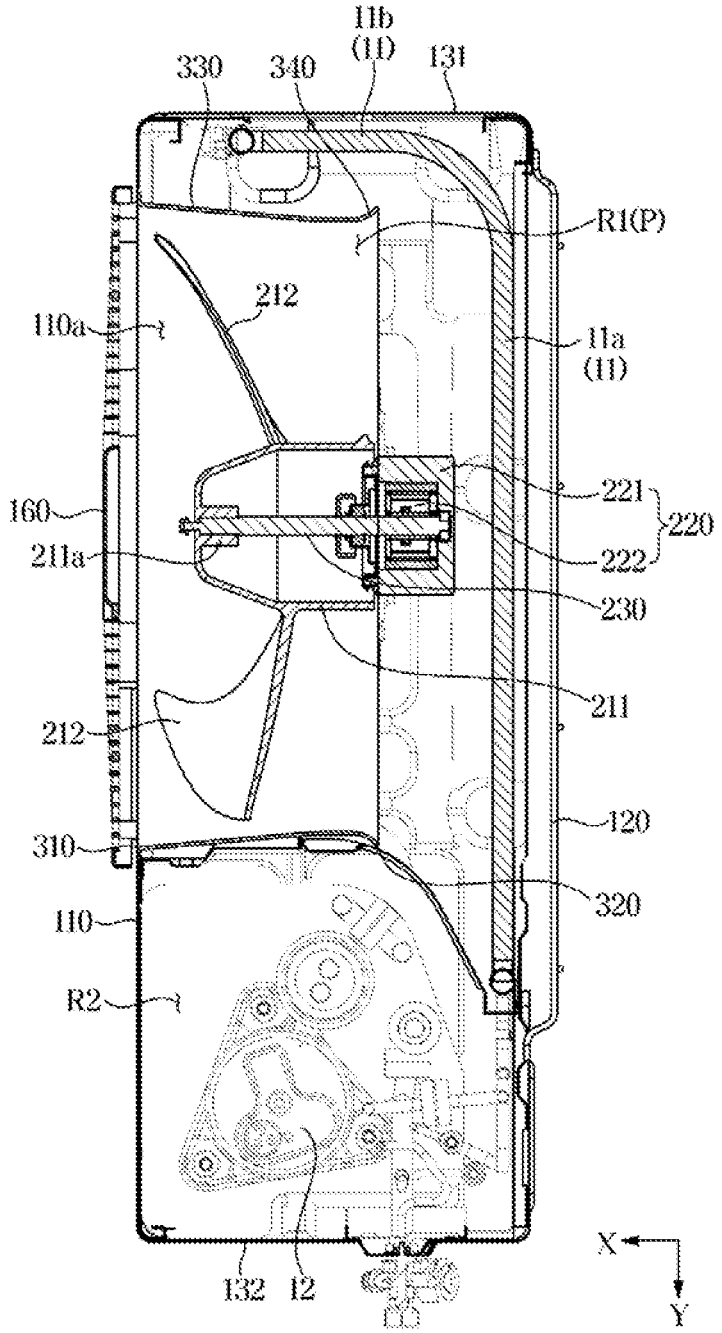
FIG. 4 is a cross-sectional view taken along line A-A' of FIG. 2.

FIG. 2 shows an outdoor unit of an air conditioner according to an embodiment of the disclosure. FIG. 3 is an exploded view of an outdoor unit of an air conditioner according to an embodiment of the disclosure. FIG. 4 is a cross-sectional view taken along line A-A' of FIG. 2.

Referring to FIGS. 2 to 4, the outdoor unit 10 of the air conditioner 1 may include the heat exchanger 11 for performing heat exchange with outdoor air, a compressor 12 for compressing refrigerants, a blower fan 210 for sucking outdoor air and blowing the outdoor air to pass the outdoor air through the heat exchanger 11, and a housing 100 forming an appearance of the outdoor unit 10.

The housing 100 may form an appearance of the outdoor unit 10. Various parts of the outdoor unit 10, such as the heat exchanger 100, the compressor 12, the blower fan 210, etc., may be accommodated inside the housing 100.

The outdoor unit 10 may include a heat exchange room R1 formed inside the housing 100.

Outdoor air may enter the heat exchange room R1, and the air may be again discharged to the outside. In the heat exchange room R1, heat exchange between the heat exchanger 11 and air received from the outside may occur. In the heat exchange room R1, components such as the heat exchanger 11, the blower fan assembly 200, etc., may be positioned.

The outdoor unit 10 may include a machine room R2 formed inside the housing 100.

In the machine room R2, components such as the compressor 12, a circuitry 13, etc., may be positioned.

Inside the housing 100, the heat exchange room R1 may be partitioned from the machine room R2. The outdoor unit 10 may include a partition 14 for partitioning the heat exchange room R1 from the machine room R2. The partition 14 may be positioned between the heat exchange room R1 and the machine room R2. For example, the heat exchange room R1 and the machine room R2 may be arranged in the Y direction in the drawings, and the partition 14 may extend in the Z direction in the drawings to partition the heat exchange room R1 from the machine room R2.

The housing 100 may include a front frame 110 forming a front appearance of the outdoor unit 10. The front frame 110 may be positioned toward a front direction of the outdoor unit 10.

The front frame 110 may form a front surface of the outdoor unit 10. The "front direction" of the outdoor unit 10 may indicate a front direction toward the X direction in the drawings, and the "front surface" of the outdoor unit 10 may indicate a front surface toward the X direction in the drawings.

For example, the front frame 110 may cover the heat exchange room R1 and the machine room R2 in the front direction.

The front frame 110 may be formed in a shape of a substantially flat plate, although not limited thereto. However, the front frame 110 may have various shapes.

The front frame 110 may include a metal material, although not limited thereto. However, the front frame 110 may include various materials.

Generally, upon installation of the outdoor unit 10 in an outdoor space, the front frame 110 may be positioned toward a space such as a road where users or passers use.

The housing 100 may include a rear frame 120 forming a portion of a rear appearance of the outdoor unit 10. The rear frame 120 may be formed toward a rear direction of the outdoor unit 10. The "rear direction" of the outdoor unit 10 may indicate a rear direction toward the X direction in the drawings.

For example, the rear frame 120 may be positioned behind the heat exchange room R1.

The rear frame 120 may have a shape resulting from crossing a plurality of bars and coupling the plurality of bars to each other. In other words, the rear frame 120 may have a shape in which a plurality of bars are arranged substantially in a lattice form.

Each of the plurality of bars of the rear frame 120 may include a metal material. The plurality of bars of the rear frame 120 may be coupled to each other by welding, etc., although not limited thereto. However, the rear frame 120 may have various shapes and include various materials.

Generally, upon installation of the outdoor unit 10 in an outdoor space, the rear frame 120 may be positioned toward an outer wall, etc. of a building.

The housing 100 may include a side frame 130 forming an appearance in left-right direction of the outdoor unit 10. The side frame 130 may be formed toward left right directions of the outdoor unit 10. The side frame 130 may form a side surface in left-right direction of the outdoor unit 10. The "left-right direction" of the outdoor unit 10 may be the Y direction in the drawings.

The side frame 130 may include a first side frame 131 and a second side frame 132. The first side frame 131 may form any one of both side surfaces in left-right direction of the outdoor unit 10, and the second side frame 132 may form another one of the both side surfaces in left-right direction of the outdoor unit 10.

For example, the first side frame 131 may cover the heat exchange room R1. The first side frame 131 may cover the heat exchange room R1 in a side direction toward the Y direction.

The first side frame 131 may connect the front frame 110 to the rear frame 120. In other words, the first side frame 131 may be connected to the front frame 110 and the rear frame 120.

The first side frame 131 may extend in a front-rear direction. The first side frame 131 may be formed in a shape of a substantially flat plate, although not limited thereto. However, the first side frame 131 may have various shapes.

The first side frame 131 may include a metal material, although not limited thereto. However, the first side frame 131 may include various materials.

For example, the second side frame 132 may cover the machine room R2. At least one portion of the second side frame 132 may cover the machine room R2 in the side direction toward the Y direction, and another portion of the second side frame 132 may cover the machine room R2 in the rear direction toward the X direction. That is, the second side frame 132 may form a portion of the side surfaces in left-right direction of the outdoor unit 10, while forming a portion of a rear surface of the outdoor unit 10. The second side frame 132 may block the machine room R2 from the outside of the outdoor unit 10.

At least one portion of the second side frame 132 may cover the machine room R2 in the Y direction and extend in the front-rear direction. At least another portion of the second side frame 132 may cover the machine room R2 in the rear direction toward the X direction and extend in the Y direction. That is, the second side frame 132 may be formed in a shape of a substantially bent plate, although not limited thereto. However, the second side frame 132 may have various shapes.

The second side frame 132 may connect the front frame 110 to the rear frame 120. In other words, the second side frame 132 may be connected to the front frame 110 and the rear frame 120.

The second side frame 132 may include a metal material, although not limited thereto. However, the second side frame 132 may include various materials.

The housing 100 may include a base 140 forming a lower surface of the outdoor unit 10. The base 140 may form a lower appearance of the outdoor unit 10. The base 140 may be positioned toward a lower direction of the outdoor unit 10. The "lower direction" of the outdoor unit 10 may be a lower direction toward the Z direction in the drawings.

For example, the base 140 may cover the heat exchange room R1 and the machine room R2 in the lower direction. The base 140 may support lower portions of various components of the outdoor unit 10, accommodated inside the housing 100.

The base 140 may be connected to lower portions of the front frame 110, the rear frame 120, and the side frame 130.

The base 140 may be formed in a shape of a substantially flat plate, although not limited thereto. However, the base 140 may have various shapes.

The base 140 may include substantially a metal material, although not limited thereto. However, the base 140 may include various materials.

The housing 100 may include a top cover 150 forming an upper surface of the outdoor unit 10. The top cover 150 may form an upper appearance of the outdoor unit 10. The top cover 150 may be positioned toward an upper direction of the outdoor unit 10. The "upper direction" of the outdoor unit 10 may be the Z direction in the drawings, and the "upper surface" of the outdoor unit 10 may be an upper surface in the Z direction in the drawings.

For example, the top cover 150 may cover the heat exchange room R1 and the machine room R2 in the upper direction. The top cover 150 may cover various components of the outdoor unit 10, accommodated inside the housing 100, from above.

The top cover 150 may be connected to upper portions of the front frame 110, the rear frame 120, and the side frame 130.

The top cover 150 may be formed in a shape of a substantially flat plate, although not limited thereto. However, the top cover 150 may have various shapes.

The top cover 150 may include substantially a metal material, although not limited thereto. However, the top cover 150 may include various materials.

The front frame 110, the rear frame 120, the side frame 130, the base 140, the top cover 150, etc., as described above, as components included in the housing 100, may be provided as separate components. However, at least some of the front frame 110, the rear frame 120, the side frame 130, the base 140, the top cover 150, etc., as the components included in the housing 100 may be integrated into one body.

For example, the housing 100 may have substantially a box shape. That is, the outdoor unit 10 may have substantially a box shape, although not limited thereto. However, the housing 100 may have various shapes.

The housing 100 may include an inlet grille 160 covering an inlet (which will be described below) 110*a* of the outdoor unit 10. The inlet grille 160 may have substantially a grille shape to pass air through. The inlet grille 160 may have a shape corresponding to a shape of the inlet 110.

The inlet grille 160 may form a portion of a front appearance of the outdoor unit 10. The inlet grille 160 may be positioned toward the front direction of the outdoor unit 10. The inlet grille 160 may cover the inlet 110*a* in the front direction. The inlet grille 160 may cover the heat exchange room R1 in the front direction.

The inlet grille 160 may be coupled to the front frame 110. For example, the inlet grille 160 may be detachably installed in the front frame 110.

The housing 100 may pass air through. The housing 100 may include the inlet 110*a* through which outside air of the housing 100 enters inside of the housing 100, and an outlet 120*b* and 131*b* through which inside air of the housing 100 is discharged to the outside of the housing 100.

The inlet 110*a* may communicate the inside of the housing 100 with the outside of the housing 100. Upon driving of a blower fan assembly 200 which will be described below, outside air of the outdoor unit 10 may enter the inside of the housing 100 through the inlet 110*a*. More specifically, the inlet 110*a* may communicate the heat exchange room R1 with the outside of the housing 100, and upon driving of the blower fan assembly 200, outside air of the outdoor unit 10 may enter the heat exchange room R1 through the inlet 110*a*.

The inlet 110*a* may be formed in a front portion of the outdoor unit 10. For example, the inlet 110*a* may be formed in the front frame 110. The inlet 110*a* may be positioned in front of the heat exchange room R1.

The outlet 120*b* and 131*b* may communicate the inside of the housing 100 with the outside of the housing 100. Upon driving of the blower fan assembly 200 which will be described below, inside air of the housing 100 may be discharged to the outside of the housing 100 through the outlet 120*b* and 131*b*. More specifically, the outlet 120*b* and 131*b* may communicate the heat exchange room R1 with the outside of the housing 100, and upon driving of the blower fan assembly 200, inside air of the heat exchange room R1 may be discharged to the outside of the outdoor unit 10 through the outlet 120*b* and 131*b*.

The outlet 120*b* and 131*b* may be positioned behind the inlet 110*a*. To improve heat-exchange efficiency, the outlet 120*b* and 131*b* may be positioned to correspond to a location of the heat exchanger 11, as shown in FIGS. 2 to 4. For example, at least a portion of the outlet 120*b* and 131*b* may be formed in the rear frame 120. For example, at least another portion of the outlet 120*b* and 131*b* may be formed in the first side frame 131. In other words, the outlet 120*b* and 131*b* may be positioned behind the heat exchange room R1 in the X direction or beside the heat exchange room R1 in the Y direction, although not limited thereto.

However, the outlet 120*b* and 131*b* of the housing 100 may be positioned at various locations according to a shape, a position, etc. of the heat exchanger 11.

The outdoor unit 10 may include a flow path P provided inside the housing 100. Inside the housing 100, air may flow along the flow path P. More specifically, the flow path P may be formed inside the heat exchanger R1.

The flow path P may be formed from the inlet 110*a* toward the outlet 120*b* and 131*b*. Upon driving of the blower fan assembly 200 which will be described below, air entered the inside of the housing 100 through the inlet 110*a* may flow along the flow path P to pass through the heat exchanger 11, and be discharged to the outside of the housing 100 through the outlet 120*b* and 131*b*.

Details about a flow of air moving along the flow path P inside the housing 100 will be described below.

The heat exchanger 11 of the outdoor unit 10 may exchange heat with outdoor air. The heat exchanger 11 may cause refrigerants to flow therein. In the heat exchanger 11, heat exchange between refrigerants and outdoor air may occur.

For example, during a cooling operation of the air conditioner 1, a refrigerant gas being at high temperature and high pressure may be condensed in the heat exchanger 11, and while refrigerants are condensed, the refrigerants may emit heat to outdoor air. During the cooling operation of the air conditioner 1, the heat exchanger 11 may discharge a refrigerant liquid.

Also, during a heating operation of the air conditioner 1, a refrigerant liquid being at low temperature and low pressure may be evaporated in the heat exchanger 11, and while refrigerants are evaporated, the refrigerants may absorb heat from outdoor air. During the heating operation of the air conditioner 1, the heat exchanger 11 may discharge a refrigerant gas.

The heat exchanger 11 may be positioned inside the housing 100. More specifically, the heat exchanger 11 may be positioned in the heat exchange room R1. The heat exchanger 11 may be positioned on the flow path P. The heat exchanger 11 may be positioned between the inlet 110*a* and the outlet 120*b* and 131*b*. The heat exchanger 11 may be supported by the base 140. The heat exchanger 11 may extend upward in the Z direction from the base 140.

The heat exchanger 11 may be positioned behind the inlet 110*a*. At least one portion of the heat exchanger 11 may face the inlet 110*a*. The heat exchanger 11 may face the outlet 120*b* and 131*b*. The heat exchanger 11 may be positioned to correspond to the outlet 120*b* and 131*b*.

For example, the heat exchanger 11 may include a first portion 11*a* facing the inlet 110*a*, and a second portion 11*b* bent from one end of the first portion 11*a* and extending in the X direction.

The first portion 11*a* may face the outlet 120*b* formed in the rear fame 120. The first portion 11*a* may extend in the left-right direction toward the Y direction. The first portion 11*a* may be positioned behind the heat exchange room R1.

The second portion 11*b* may face the outlet 131*b* formed in the first side frame 131. The second portion 11*b* may extend in the front-rear direction toward the X direction. The second portion 11*b* may be bent from one end of the first portion 11*a* and extend in a direction toward the inlet 110*a*. The second portion 11*b* may be bent from the one end of the first portion 11*a* and extend in the front direction. The second portion 11*b* may be bent from the one end of the first portion 11*a* and extend in a longitudinal direction of a guide 300 which will be described below.

The second portion 11*b* may be positioned to one side in the Y direction of the heat exchange room R1. More specifically, the second portion 11*b* may be positioned to one of both sides in the Y direction of the heat exchange room R1, the one side being opposite to the machine room R1.

A portion of air entered the inside of the housing 100 through the inlet 110*a* and passed through the first portion 11*a* of the heat exchanger 11 may be discharged to the outside of the housing 100 through the outlet 120*b* of the rear frame 120. Another portion of air entered the inside of the housing 100 through the inlet 110*a* and passed through the second portion 11*b* of the heat exchanger 11 may be discharged to the outside of the housing 100 through the outlet 131*b* of the first side frame 130.

However, the above-described configuration of the heat exchanger 11 may be only an example of a heat exchanger that is included in an outdoor unit of an air conditioner according to a concept of the disclosure, and a concept of the disclosure is not limited to this.

The compressor 12 may compress a refrigerant gas and discharge a high-temperature, high-pressure refrigerant gas. For example, the compressor 12 may include a motor and a compression mechanism, and the compression mechanism may compress a refrigerant gas by a torque of the motor.

The compressor 12 may be positioned inside the housing 100. More specifically, the compressor 12 may be positioned in the machine room R2. The compressor 12 may be supported by the base 140.

The outdoor unit 10 may include the blower fan assembly 200 configured to generate a suction force. Upon driving of the blower fan assembly 200, a suction force may be generated, and air may enter the inside of the housing 100 through the inlet 110*a*, pass through the heat exchanger 11, and be discharged to the outside of the housing 100 through the outlet 120*b* and 131*b*.

The blower fan assembly 200 may be positioned inside the housing 100. More specifically, the blower fan assembly 200 may be positioned in the heat exchange room R1. The blower fan assembly 200 may be provided on the flow path P. The blower fan assembly 200 may be positioned between the inlet 110*a* and the outlet 120*b* and 131*b*. More specifically, the blower fan assembly 200 may be positioned between the inlet 110*a* and the heat exchanger 11.

The blower fan assembly 200 may include the blower fan 210, a fan motor 220, and a rotating shaft 230.

The fan motor 220 may generate power for rotating the blower fan 210. The fan motor 220 may receive power for driving the blower fan assembly 200 from an external power supply.

The fan motor 220 may perform a function of converting an electromagnetic force into a mechanical rotational force. To perform the function, the fan motor 220 may include a stator 221 around which a coil is wound, and a rotor 222 which includes a magnetic substance and is rotatable by an electromagnetic force. The stator 221 may be maintained at a fixed position, and the rotor 222 may be rotatable with respect to the stator 221. According to application of power to the fan motor 220, the rotor 222 may rotate with respect to the stator 221 by an electromagnetic force between the magnetic substance of the rotor 222 and the coil of the stator 221.

In FIG. 4, the fan motor 220 is shown to be an inner-rotor type in which the rotor 222 is positioned inside the stator 221, although not limited thereto. However, for example, the fan motor 220 may be an outer-rotor type in which a rotor is positioned outside a stator. However, hereinafter, an embodiment in which the fan motor 220 is an inner-rotor type will be described.

The fan motor 220 may be positioned between the inlet 110*a* and the heat exchanger 11. The fan motor 220 may be positioned upstream of the heat exchanger 11 on the flow path P. More specifically, the fan motor 220 may be positioned in front of the first portion 11*a* of the heat exchanger 11.

The rotating shaft 230 may be connected to the rotor 222. The rotating shaft 230 may penetrate the rotor 222. The rotating shaft 230 may be rotatable together with the rotor 222. According to application of power to the fan motor 220, the rotating shaft 230 may rotate with respect to the stator 221.

For example, the rotating shaft 230 may extend in the front-rear direction of the outdoor unit 10. The blower fan 210 may be connected to the rotating shaft 230. Power generated by the fan motor 220 may be transferred to the blower fan 210 through the rotating shaft 230. The blower fan 210 may be rotatable about the rotating shaft 230. That is, the rotating shaft 230 may function as a rotation axis of the blower fan 210.

According to a rotation of the blower fan 210, a pressure difference may be made in the front-rear direction of the blower fan 210. The blower fan 210 may cause air to flow from the inlet 110*a* toward the outlet 120*b* and 131*b* by the pressure difference. In other words, air on the flow path P may flow from the upstream of the flow path P toward the downstream by a pressure difference generated by a rotation.

As shown in FIGS. 2 to 4, according to a rotation of the blower fan 210, air may flow from the front direction of the blower fan 210 toward the rear direction of the blower fan 210. That is, in FIGS. 2 to 4, the front direction of the blower fan 210 may be the upstream of the flow path P, and the rear direction of the blower fan 210 may be the downstream of the flow path P.

The blower fan 210 may be positioned upstream of the heat exchanger 11 on the flow path P. The blower fan 210 may be positioned between the inlet 110 and the heat exchanger 11. The blower fan 210 may be positioned at an area of the flow path P provided between the inlet 110*a* and the heat exchanger 11. More specifically, the blower fan 210 may be positioned in front of the first portion 11*a* of the heat exchanger 11.

As shown in FIGS. 3 and 4, the blower fan assembly 200 may cause air passing through the blower fan 210 to flow in a direction corresponding to an extension direction of the rotating shaft 230 according to a rotation of the blower fan 210. That is, the blower fan assembly 200 may be an axial fan type.

Details about a configuration of the blower fan 210 will be described below.

The outdoor unit 10 may include a motor bracket 17 for supporting the blower fan assembly 200. More specifically, the motor bracket 17 may support the fan motor 220.

The fan motor 220 may be coupled to the motor bracket 17 and supported by the motor bracket 17. For example, the fan motor 220 may be fixed to the motor bracket 17 by a method such as screw-coupling, etc., although not limited thereto. However, the fan motor 220 may be coupled to the motor bracket 17 by various methods.

The motor bracket 17 may support the blower fan assembly 200 from behind. In other words, the motor bracket 17 may be coupled to a rear portion of the fan motor 220.

The motor bracket 17 may be positioned inside the housing 100. The motor bracket 17 may be positioned in the heat exchange room R1. For example, the motor bracket 17 may be positioned between the inlet 110*a* and the heat exchanger 11.

The motor bracket 17 may be supported by the housing 100. For example, the motor bracket 17 may be fixed to the base 140. For example, the motor bracket 17 may be fixed to the front frame 110.

The motor bracket 17 may not interfere with the guide 300. Accordingly, the motor bracket 17 may be positioned at various locations according to a shape and position of the guide 300. The fan motor 220 may be positioned at any location corresponding to a location of the motor bracket 17, although not limited thereto.

However, the fan motor 220 may be supported by various components.

The outdoor unit 10 may include the guide 300 for guiding air flowing along the flow path P. The guide 300 may cover the blower fan 210 in a radial direction. According to a rotation of the blower fan 210, the guide 300 may guide a flow of air passing through the blower fan 210. According to a rotation of the blower fan 210, the guide 300 may guide air to flow toward the heat exchanger 11.

For example, the guide 300 may be formed in a shape of a cylinder having substantially a cavity. In this case, the blower fan 210 may be positioned in the cavity of the guide 300.

For example, the guide 300 may extend in the front-rear direction of the outdoor unit 10. For example, an extension direction of the guide 300 may be parallel to the extension direction of the rotating shaft 230.

Details about a configuration of the guide 300 will be described below.

The outdoor unit 10 may include the circuitry 13 for controlling driving of the outdoor unit 10. The circuitry 13 may include a component such as a Printed Circuit Board (PCB) on which electronic components are mounted. The circuitry 13 may be electrically connected to various components such as the blower fan assembly 200, etc. of the outdoor unit 10.

The circuitry 13 may be accommodated inside the housing 100. For example, the circuitry 13 may be positioned in the machine room R2. Alternatively, for example, as shown in FIG. 3, a portion of the circuitry 13 may be positioned in the heat exchange room R1, and another portion may be positioned in the machine room R2.

The outdoor unit 10 may include a circuitry frame 15 supporting the circuitry 13 and a circuitry cover 16 covering the circuitry 13.

For example, the circuitry frame 15 may accommodate the circuitry 13 therein. For example, the circuitry cover 16 may cover the circuitry 13 from above.

The circuitry frame 15 may be positioned inside the housing 100. The circuitry cover 16 may be positioned inside the housing 100, although not limited thereto.

However, the circuitry 13 may be supported by various components and positioned at various locations.

The above-described configuration of the outdoor unit 10 may be only an example of an outdoor unit of an air conditioner according to a concept of the disclosure, and a concept of the disclosure is not limited to this. The outdoor unit of the air conditioner according to a concept of the disclosure may have various configurations as long as the outdoor unit receives outdoor air through an inlet, performs heat exchange with the air, and then discharges the air to the outside.

Figure 5:
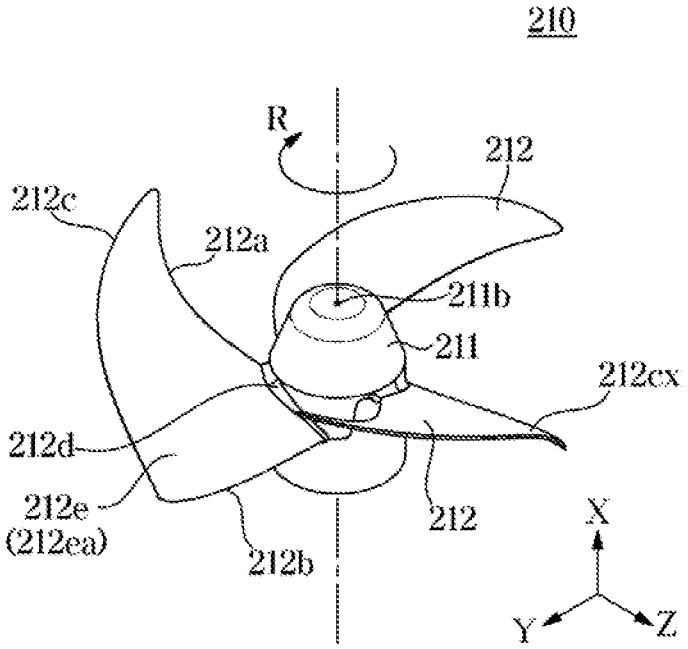
FIG. 5 shows a blower fan included in an outdoor unit of an air conditioner according to an embodiment of the disclosure.
Figure 6:
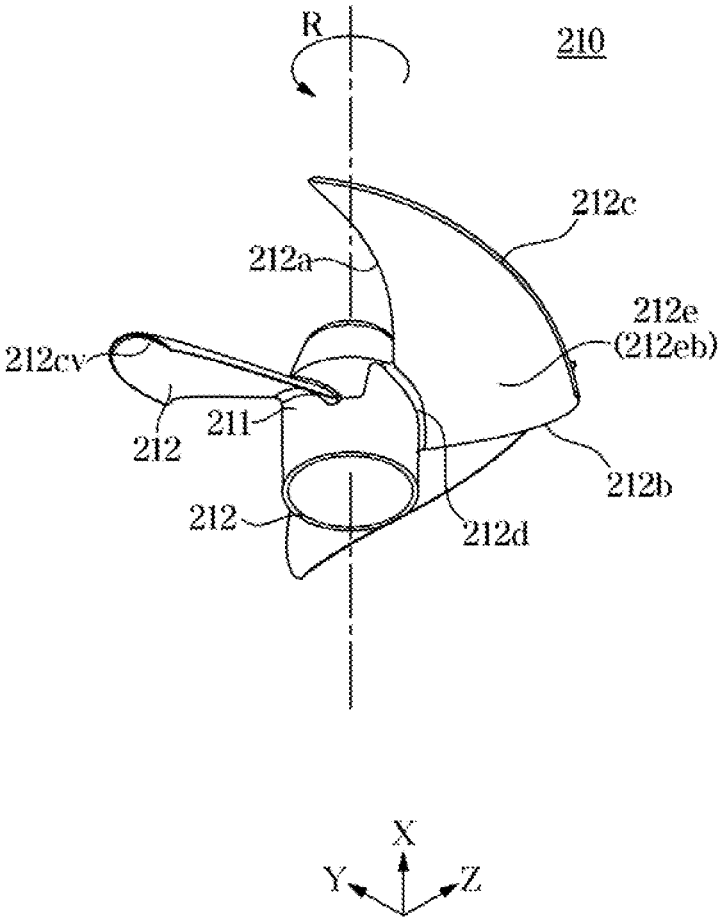
FIG. 6 shows a blower fan included in an outdoor unit of an air conditioner according to an embodiment of the disclosure.

FIG. 5 shows a blower fan included in an outdoor unit of an air conditioner according to an embodiment of the disclosure. FIG. 6 shows a blower fan included in an outdoor unit of an air conditioner according to an embodiment of the disclosure.

Referring to FIGS. 5 and 6, the blower fan 210 may include a hub 211 and a plurality of blades 212 extending from the hub 211.

The hub 211 may be rotatable about the rotating shaft 230. The hub 211 may be connected to the rotating shaft 230, and accordingly, the hub 211 may receive power generated in the fan motor 220.

The hub 211 may be rotatable together with the rotating shaft 230 by being coupled to the rotating shaft 230. For example, the hub 211 may include a shaft coupling portion 211*a* (see FIG. 4) to which the rotating shaft 230 is coupled. The rotating shaft 230 may be fixed to the shaft coupling portion 211*a*.

For example, the shaft coupling portion 211*a* may have a shape corresponding to an end of the rotating shaft 230, and by inserting the end of the rotating shaft 230 into the shaft coupling portion 211*a*, the rotating shaft 230 may be fixed to the hub 211. For example, the end of the rotating shaft 230 may be fixed to the hub 211 by being pressed in the shaft coupling portion 211*a*.

For example, the rotating shaft 230 may penetrate the hub 211. The hub 211 may include a shaft through hole 211*b*, and the rotating shaft 230 may penetrate the shaft through hole 211*b*.

For example, the hub 211 may be fixed to the rotating shaft 230 by a coupling member for coupling the hub 211 to the rotating shaft 230 from outside the shaft through hole 211*b*, although not limited thereto.

However, the hub 211 may be connected to the rotating shaft 230 by various components.

The hub 211 may be formed such that a cross section resulting from cutting the hub 211 into an arbitrary plane being orthogonal to the rotating shaft 230 has a substantially circular shape. In other words, the hub 211 may be formed such that a cross section resulting from cutting the hub 211 into an arbitrary plane that is parallel to a Y-Z plane in the drawings has a substantially circular shape.

The hub 211 may extend in a direction that is parallel to the rotating shaft 230. In the drawings, the hub 211 may extend in the front-rear direction toward the X direction. In this case, an extension length of the hub 211 may depend on a shape of the guide 300, a position of the fan motor 220, a position of the motor bracket 17, etc.

For example, the guide 300 may include a diffuser 340 extending in the rear direction behind a trailing edge 212*b* of each blade 211, which will be described below. In this case, compared to a case (see FIGS. 10 and 11) in which there is no diffuser 340, the motor bracket 17 may be positioned relatively in the rear direction and the fan motor 220 may also be positioned relatively in the rear direction to correspond to a location of the motor bracket 17, not to interfere with the diffuser 340. Accordingly, the hub 211 of the blower fan 210 shown in FIGS. 5 and 6 may have a relatively longer length in the front-rear direction compared to the case in which there is no diffuser 340. As shown in FIGS. 5 and 6, the hub 211 may extend such that a rear end of the hub 211 is positioned behind the trailing edge 212*b* at an inner end 212*d* of the blade 212.

Likewise, an extension length in front-rear direction of the rotating shaft 230 connecting the fan motor 220 to the hub 211 may depend on a shape of the guide 300, a position of the fan motor 220, a position of the motor bracket 17, etc.

For example, in a case in which the guide 300 includes the diffuser 340, the rotating shaft 230 may have a relatively longer length in the front-rear direction compared to the case in which there is no diffuser 340.

The plurality of blades 212 may be arranged along a circumference of the hub 211. The plurality of blades 212 may be rotatable together with the hub 211. That is, the plurality of blades 212 may be rotatable about the rotating shaft 230.

The plurality of blades 212 may extend from an outer circumferential surface of the hub 211. The plurality of blades 212 may extend from the hub 211 substantially in a radial direction of the hub 211.

For example, the hub 211 and the plurality of blades 212 may be integrated into one body, although not limited thereto. However, for example, the hub 211 and the plurality of blades 212 may be formed as separate components.

The plurality of blades 212 may have shapes corresponding to each other.

The plurality of blades 212 may be arranged at regular intervals.

In FIGS. 5 and 6, three blades 212 are connected to the hub 211. However, this is only an example, and a concept of the disclosure is not limited to this.

According to application of power to the fan motor 220, the blower fan 210 may be rotatable in a R direction shown in FIGS. 5 and 6. The blower fan 210 may be rotatable in an opposite direction of the R direction according to a direction of current applied to the fan motor 220. However, according to an embodiment of the disclosure, it is assumed that a direction of current applied to the fan motor 220 is set to a direction of rotating the blower fan 210 in the R direction.

Each of the plurality of blades 212 may include a leading edge 212*a* positioned at a side of the rotation direction R of the hub 211, and the trailing edge 212*b* positioned opposite to the leading edge 212*b*. The leading edge 212*a* may be an edge of the blade 212, positioned toward the rotation direction R, and the trailing edge 212*b* may be an opposite edge of the leading edge 212*a*.

The leading edge 212*a* and the trailing edge 212*b* may extend from the hub 211.

For example, an angle of inclination of an extension direction of the leading edge 212*a* with respect to the radial direction of the hub 211 may be greater than an angle of inclination of an extension direction of the trailing edge 212*b* with respect to the radial direction of the hub 211.

For example, an extension length of the leading edge 212*a* from the hub 211 may be longer than an extension length of the trailing edge 212*b* from the hub 211, although not limited thereto. However, the leading edge 212*a* and the trailing edge 212*b* may have various shapes.

Each of the plurality of blades 212 may include the inner end 212*d* provided at an inner edge connected to the hub 211, and an outer end 212*c* provided at an outer edge in extension direction of each of the plurality of blades 212. Each of the plurality of blades 212 may extend from the inner end 212*d* to the outer end 212*c*.

Each of the plurality of blades 212 may include a blade surface 212*e* formed between the leading edge 212*a* and the trailing edge 212*b*. In other words, the leading edge 212*a* may be an edge of the blade surface 212*e*, positioned toward the rotation direction R, and the trailing edge 212*b* may be another edge of the blade surface 212*e*, positioned toward the opposite direction of the rotation direction R.

The blade surface 212*e* may extend from the hub 211. The inner end 212*d* may be provided at an inner edge of the blade surface 121*e* connected to the hub 211. The outer end 212*c* may be provided at an outer edge of the blade surface 212*e* in an extension direction of the blade surface 212*e* from the hub 211. The blade surface 212*e* may extend from the inner end 212*d* to the outer end 212*c*.

According to a rotation of the blower fan 210, surrounding air of the blower fan 210 may flow along the blade surface 212*e*. According to the flow of air along the blade surface 212*e*, a pressure difference may be made between the upstream and the downstream of the flow path P with respect to the blower fan 210. In the drawings, a front direction of the blower fan 210 in the X direction may be the upstream and a rear direction of the blower fan 210 in the X direction may be the downstream.

Each of the plurality of blades 212 may be inclined downstream of the flow path P from the leading edge 212*a* toward the trailing edge 212*b*. Each of the plurality of blades 212 may be inclined closer to the inlet 110*a* from the trailing edge 212*b* toward the leading edge 212*a*.

More specifically, the blade surface 212*e* may be inclined downstream of the flow path P from the leading edge 212*a* toward the trailing edge 212*b*. In other words, the blade surface 212*e* may be inclined upstream of air from the trailing edge 212*b* toward the leading edge 212*a*. In other words, the blade surface 212*e* may be inclined closer to the inlet 110*a* from the trailing edge 212*b* toward the leading edge 212*a*. In the drawings, the blade surface 212*e* may be inclined toward the rear direction of the outdoor unit 10 from the leading edge 212*a* to the trailing edge 212*b*.

The first portion 11*a* of the heat exchanger 11 may face the inlet 110*a*. Each of the plurality of blades 212 may be positioned such that the trailing edge 212*b* is closer to at least one portion of the heat exchanger 11, the at least one portion facing the inlet 110*a*, than the leading edge 212*a*.

The leading edge 212*a* may extend from the hub 211 in a direction toward the upstream of the flow path P. The leading edge 212*a* may extend from one end connected to the hub 211 to another end being opposite to the one end in the direction toward the upstream of the flow path P. The one end of the leading edge 212*a*, connected to the hub 211, may be positioned further downstream of the flow path P than the other end being opposite to the one end. That is, the one end of the leading edge 212*a*, connected to the hub 211, may be more distant from the inlet 110*a* than the other end being opposite to the one end.

The leading edge 212*a* may extend from one end positioned toward the guide 300 to another end being opposite to the one end in the direction toward the downstream of the flow path P. The one end of the leading edge 212*a*, positioned toward the guide 300, may be positioned further upstream of the flow path P than the other end being opposite to the one end. That is, the one end of the trailing edge 212*a*, positioned toward the guide 300, may be positioned closer to the inlet 110*a* than the other end being opposite to the one end.

The outer end 212*c* of each of the plurality of blades 212 may be inclined to correspond to the blade surface 212*e*.

The outer end 212*c* of each of the plurality of blades 212 may extend toward the upstream of the flow path P from the trailing edge 212*b* toward the leading edge 212*a*. The outer end 212*c* may be formed such that one end positioned toward the leading edge 212*a* is positioned upstream of the flow path P than another end positioned toward the trailing edge 212*b*. The end of the outer end 212*c*, positioned toward the leading edge 212*a* may be closer to the inlet 110*a* than the end positioned toward the trailing edge 212*b*. The end of the outer end 212*c*, positioned toward the trailing edge 212*b* may be closer to the first portion 11*a* of the heat exchanger 11 than the end positioned toward the leading edge 212*a*.

The inner end 212*d* of each of the plurality of blades 212 may be inclined to correspond to the blade surface 212*e*.

The inner end 212*d* of each of the plurality of blades 212 may extend toward the upstream of the flow path P from the trailing edge 212*b* toward the leading edge 212*a*. The inner end 212*d* may be formed such that an end positioned toward the leading edge 212*a* is positioned upstream of the flow path P than another end positioned toward the trailing edge 212*b*. The end of the inner end 212*d*, positioned toward the leading edge 212*a* may be closer to the inlet 110*a* than the end positioned toward the trailing edge 212*b*. The end of the inner end 212*d*, positioned toward the trailing edge 212*b* may be closer to the first portion 11*a* of the heat exchanger 11 than the end positioned toward the leading edge 212*a*.

As such, each of the plurality of blades 212 may be formed such that the leading edge 212*a* is positioned upstream of the flow path P than the trailing edge 212*b* and the blade surface 212*e* is inclined between the leading edge 212*a* and the trailing edge 212*b*.

The blade surface 212*e* may include an upstream surface 212*ea* facing an upstream direction of the flow path P and a downstream surface 212*eb* facing a downstream direction of the flow path P.

The upstream surface 212*ea* may face the inlet 110*a*. The downstream surface 212*eb* may face the first portion 11*b* of the heat exchanger 11. In the drawings, the upstream surface 212*ea* may be toward the front direction of the outdoor unit 10, and the downstream surface 212*eb* may be toward the rear direction of the outdoor unit 10.

Each of the upstream surface 212*ea* and the downstream surface 212*eb* may be inclined downstream of the flow path P from the leading edge 212*a* toward the trailing edge 212*b*. Each of the upstream surface 212*ea* and the downstream surface 212*eb* may be inclined upstream of the flow path P from the trailing edge 212*b* toward the leading edge 212*a*.

According to a rotation in R direction of the blower fan 210, the upstream surface 212*ea* may become a suction surface of the blade 212. According to the rotation in R direction of the blower fan 210, the downstream surface 212*eb* may become a pressure surface of the blade 212.

That is, according to a rotation in R direction of the blower fan 210, negative pressure may be formed in surrounding air of the upstream surface 212*ea*, and positive pressure may be formed in surrounding air of the downstream surface 212*eb*. Air flowing along the flow path P may move in a direction from the upstream surface 212*ea* toward the downstream surface 212*eb*.

Each of the plurality of blades 212 may be formed such that the blade surface 212*e* has a preset curvature.

For example, the upstream surface 212*ea* may include a convex surface 212*cx* that is convex toward the upstream direction of the flow path P.

The convex surface 212*cx* may be provided in at least a portion of the upstream surface 212*ea*, the portion being adjacent to the trailing edge 212*b*. The convex surface 212*cx* may extend in the direction toward the leading edge 212*a* from the trailing edge 212*b*.

For example, the convex surface 212*cx* may extend from the trailing edge 212*b* up to a portion of the upstream surface 212*ea* positioned between the trailing edge 212*b* and the leading edge 212*a*. However, for example, an entire of the upstream surface 212*ea* may be convex toward the upstream direction of the flow path P.

For example, the downstream surface 212*eb* may include a concave surface 212*cv* that is concave from the downstream direction of the flow path P toward the upstream direction.

The concave surface 212*cv* may be provided in at least a portion of the downstream surface 212*eb*, the portion being adjacent to the trailing edge 212*b*. The concave surface 212*cv* may extend in the direction toward the leading edge 212*a* from the trailing edge 212*b*.

For example, the concave surface 212*cv* may extend from the trailing edge 212*b* up to a portion of the downstream surface 212*eb*, the portion being positioned between the trailing edge 212*b* and the leading edge 212*a*. Unlike this, for example, an entire of the downstream surface 212*eb* may be concave from the downstream direction of the flow path P toward the upstream direction.

For example, the concave surface 212*cv* may have a smaller inclination with respect to the extension direction of the rotating shaft 230 toward the trailing edge 212*b*. That is, the concave surface 212*cv* may have a smaller inclination with respect to the downstream direction of the flow path P toward the trailing edge 212*b*. The concave surface 212*cv* may have a smaller inclination with respect to the front-rear direction as the X direction in the drawings toward the trailing edge 212*b*.

For example, the concave surface 212*cv* may be provided at a location corresponding to the convex surface 212*cx* in the front-rear direction.

By the above-described configuration, according to a rotation in R direction of the blower fan 210, air flowing along the blade surface 212*e* may move more efficiently from the upstream of the flow path P toward the downstream.

However, a curvature of the blade surface 212*e* is not limited to this. For example, the blade surface 212*e* may have a substantially flat shape.

Figure 7:
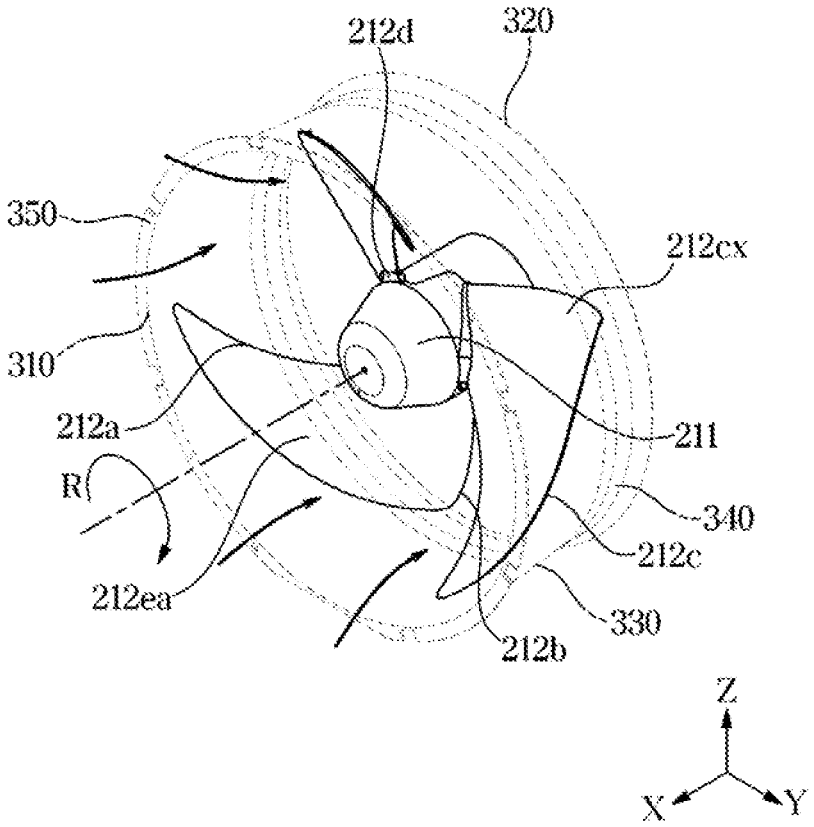
FIG. 7 shows a state in which air flows in some components of an outdoor unit of an air conditioner according to an embodiment of the disclosure.
Figure 8:
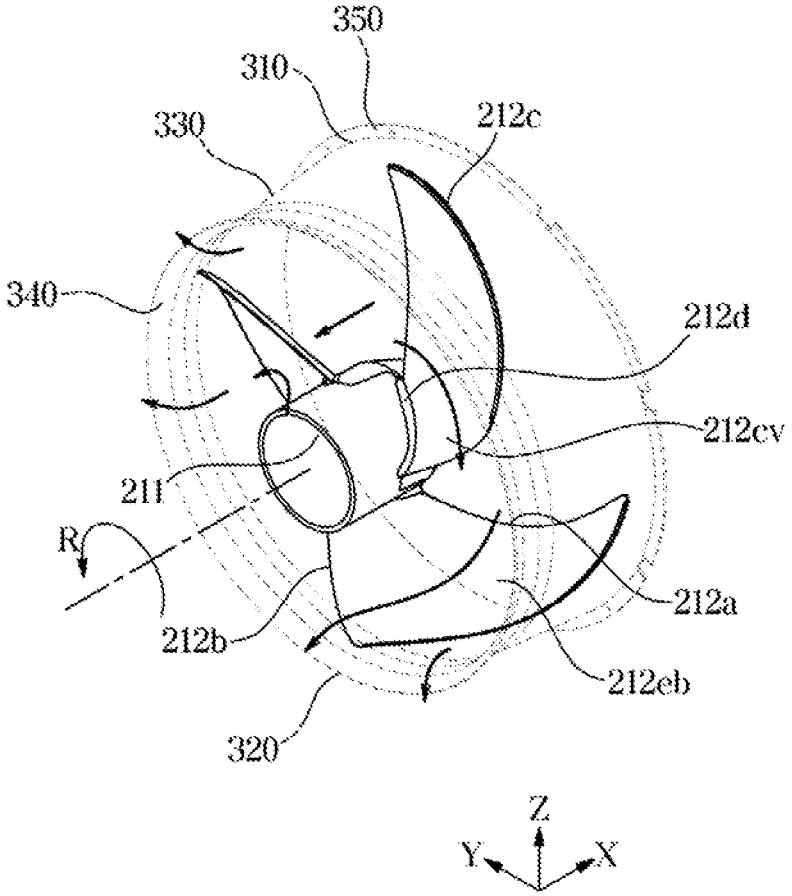
FIG. 8 shows a state in which air flows in some components of an outdoor unit of an air conditioner according to an embodiment of the disclosure.
Figure 9:
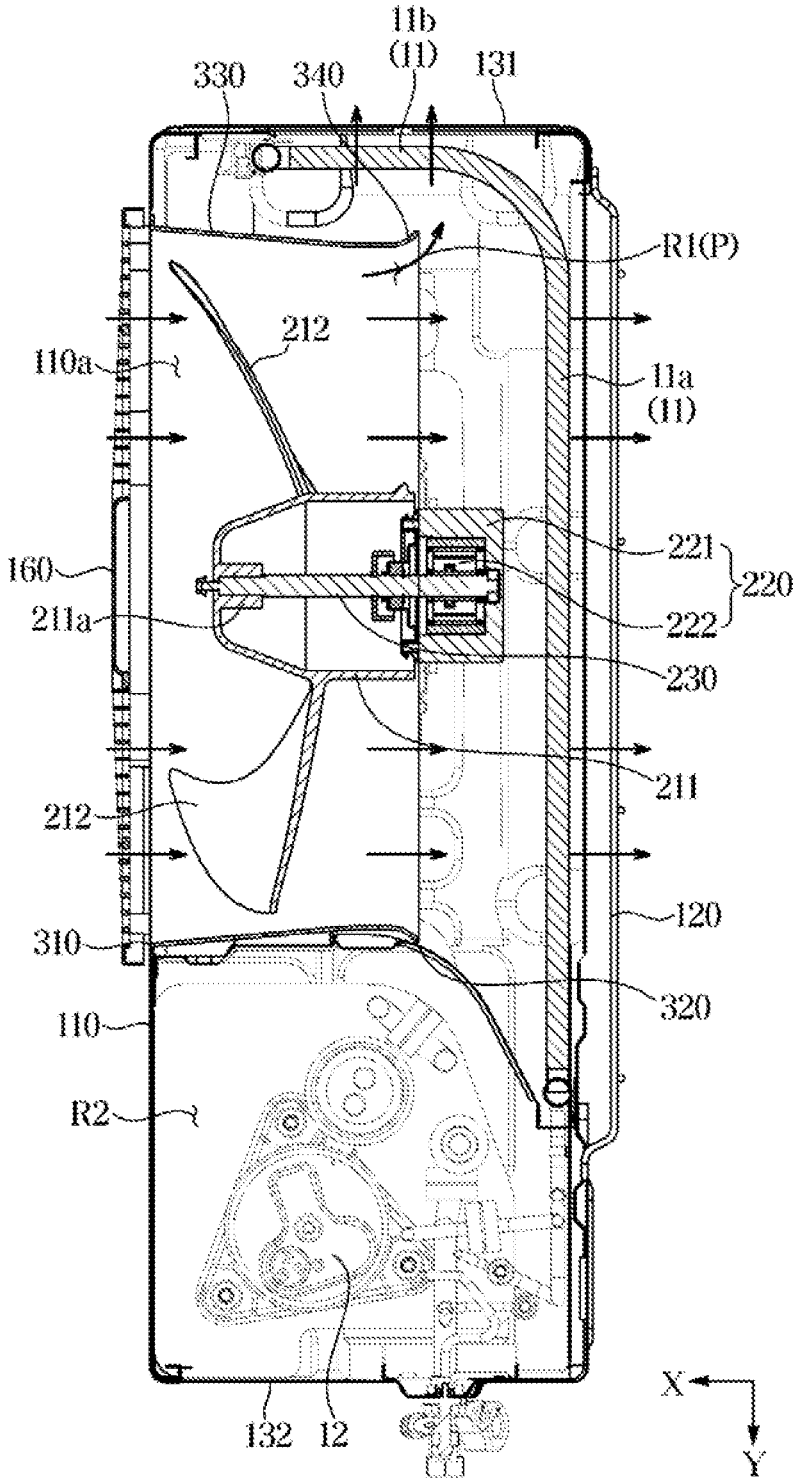
FIG. 9 is a cross-sectional view showing a state in which air flows in an outdoor unit of an air conditioner according to an embodiment of the disclosure.

FIG. 7 shows a state in which air flows in some components of an outdoor unit of an air conditioner according to an embodiment of the disclosure. FIG. 8 shows a state in which air flows in some components of an outdoor unit of an air conditioner according to an embodiment of the disclosure. FIG. 9 is a cross-sectional view showing a state in which air flows in an outdoor unit of an air conditioner according to an embodiment of the disclosure.

Referring to FIGS. 7 to 9, according to a rotation in R direction of the blower fan 210, outside air of the outdoor unit 10 may enter the outdoor unit 10 through the inlet 110*a* provided in the front frame 110, and the air may pass through the heat exchanger 11 and be discharged through the outlet 120*b* and 131*b* provided in the rear frame 120 or the first side frame 131.

The outdoor unit 10 may be positioned such that the front frame 110 is toward a space such as a road which users or passers use and the rear frame 120 is toward an outer wall, etc. of a building.

The rear frame 120 positioned adjacent to the heat exchanger 11 may have a lattice form in which a plurality of bars are crossed with each other and arranged, as described above, and the heat exchanger 11 inside the housing 100 may be easily seen through the rear frame 120 from the outside. Unlike this, the front frame 110 may be formed in a shape of an entirely flat plate having an opening, the opening of the front frame 110 may be covered by the inlet grille 160, and the inside of the housing 100 may be not easily seen through the front frame 110 from the outside.

Accordingly, by installing the outdoor unit 10 such that the front frame 110 is toward a space which users or passers use, apparent quality may be improved and the heat exchanger 11 may be protected from an impact source outside the outdoor unit 10.

Unlike the outdoor unit 10 according to an embodiment of the disclosure, a case in which an outlet for discharging air from the outdoor unit 10 is formed in the front frame 110 may be assumed. In this case, heat-exchanged air may be discharged toward a space in which users or passers use, which may cause the users' or passers' inconvenience.

In the outdoor unit 10 of the air conditioner 1 according to an embodiment of the disclosure, according to a rotation in R direction of the blower fan 210, air may enter the inlet 110*a* formed in the front frame 110 and heat-exchanged air may be discharged through the outlet 120*b* and 131*b* provided in the rear frame 120 or the first side frame 131, thereby preventing users' or passers' inconvenience.

As described above, each of the plurality of blades 212 of the blower fan 210 may be inclined toward the downstream of the flow path P from the leading edge 212*a* toward the trailing edge 212*b*.

According to a rotation in R direction of the blower fan 210, air on the flow path P may flow in a direction from the upstream surface 212*ea* toward the downstream surface 212*eb*.

According to a rotation of the blower fan 210, outdoor air may enter the inlet 110*a* positioned in front of the blower fan 210. Air passing through the blower fan 210 may flow along the blade surface 212*e*. The downstream surface 212*eb* may guide air received through the inlet 110*a* to flow from the leading edge 212*a* toward the trailing edge 212*b*.

By the shape of the plurality of blades 212, the blower fan 210 may cause a flow of air with high blowing efficiency.

The air conditioner 1 may include the guide 300 for guiding air flowing along the flow path P. The guide 300 may be formed along a circumferential direction of the plurality of blades 212. The guide 300 may guide, according to a rotation of the blower fan 210, air received through the inlet 110*a* to flow efficiently toward the heat exchanger 11.

The guide 300 may have a cylindrical shape having substantially a cavity. The blower fan 210 may be positioned inside the cavity of the guide 300. The blower fan 210 may be positioned in a center area of the guide 300.

According to a rotation in R direction of the blower fan 210, a portion of air flowing from the leading edge 212*a* toward the trailing edge 212*b* along the downstream surface 212*eb* may intend to deviate from the downstream surface 212*eb* in a state of not sufficiently moving in the rear direction of the blower fan 210.

To prevent this, the guide 300 may cover the trailing edge 212*b* of each of the plurality of blades 212 from the outside. In other words, the guide 300 may cover the trailing edge 212*b* of each of the plurality of blades 212 from the outside in the radial direction of the hub 211.

For example, the guide 300 may extend from the inlet 110*a* toward the heat exchanger 11, at least up to the trailing edge 212*b* of the blade 212. More specifically, the guide 300 may extend in a direction from the inlet 110*a* toward the first portion 11*a* of the heat exchanger 11. The direction in which the guide 300 extends from the inlet 110*a* may be a direction corresponding to the front-rear direction of the outdoor unit 10. Unlike this, for example, the guide 300 may cover at least the trailing edge 212*b* of the blade 212 and a portion of the blade 212 being adjacent to the trailing edge 212*b*.

By the configuration, the guide 300 may guide air deviating from the downstream surface 212*eb* without reaching the trailing edge 212*b* to flow toward the heat exchanger 11.

Hereinafter, an example of a detailed configuration of the guide 300 will be described.

The guide 300 may include an inlet end 310 through which air enters the guide 30, and an outlet end 320 through which air is discharged from the guide 300.

The inlet end 310, which is an end in upstream direction of the guide 300, may be formed in a shape of an opening. The outlet end 320, which is another end in downstream direction of the guide 300, may be formed in a shape of an opening.

According to a rotation of the blower fan 210, air entered the inside of the outdoor unit 10 through the inlet 110*a* may enter the guide 300 through the inlet end 310. The air entered the guide 300 through the inlet end 310 may flow along the guide 300 in the rear direction. The air flowing along the guide 300 may reach the outlet end 320 and be discharged to outside of the guide 300. The air discharged to the outside of the guide 300 through the outlet end 320 may pass through the heat exchanger 11 and be discharged to the outside of the outdoor unit 10 through the outlet 120*b* and 131*b*.

For example, the inlet end 310 may face the inlet 110*a*. For example, the outlet end 320 may face the first portion 11*a* of the heat exchanger 11.

For example, the inlet end 310 may be opposite to the outlet end 320 in the extension direction of the rotating shaft 230. In other words, the inlet end 310 may be opposite to the outlet end 320 in the front-rear direction of the outdoor unit 10.

The guide 300 may include a bell mouth 330 extending from the inlet end 310 toward the outlet end 320. More specifically, the bell mouth 330 may extend from the inlet end 310 toward the diffuser 340 which will be described below. In other words, the bell mouth 330 may extend from the inlet end 310 in the downstream direction of the flow path P, up to an end in upstream direction of the diffuser 340.

The bell mouth 330 may be reduced in width from the inlet end 310 toward the outlet end 320. In other words, the bell mouth 330 may be reduced in width from the upstream of the flow path P toward the downstream. In other words, the bell mouth 330 may be reduced in width toward the rear direction of the outdoor unit 10. In other words, the 'width' of the bell mouth 330 may be a diameter of the bell mouth 330 as shown in the drawings.

The bell mouth 330 may cover the trailing edge 212*b* of each of the plurality of blades 212 from the outside. More specifically, the bell mouth 330 may cover an outer end of the trailing edge 212*b* in the radial direction of the hub 211. The outer end of the trailing edge 212*b* may be an end of the trailing edge 212*b*, being opposite to the hub 211.

The bell mouth 330 may extend from the inlet 110*a*, at least up to the trailing edge 212*b*. For example, the bell mouth 330 may be positioned such that a rear end of the bell mouth 330 covers the outer end of the trailing edge 212*b* in the radial direction of the hub 211. In other words, the bell mouth 330 may be positioned such that the rear end of the bell mouth 330 is positioned at or behind a location corresponding to the outer end of the trailing edge 212*b*.

The guide 300 may include the diffuser 340 extending from the outlet end 320 toward the inlet end 310. More specifically, the diffuser 340 may extend from the outlet end 320 toward the bell mouth 330. In other words, the diffuser 340 may extend from the end in downstream direction of the bell mouth 330 in the downstream direction of the flow path P, up to the outlet end 320.

The diffuser 340 may increase in width toward the outlet end 320. In other words, the diffuser 340 may increase in width from the upstream of the flow path P toward the downstream. In other words, the diffuser 340 may increase in width toward the rear direction of the outdoor unit 10. The 'width' of the diffuser 340 may be a diameter of the diffuser 340, as shown in the drawings.

The diffuser 340 may guide air to flow in a diffusion direction while being discharged from the guide 300 through the outlet end 320. Accordingly, the diffuser 340 may cause at least one portion of air flowing along the outlet end 320 to flow toward the second portion 11*b* of the heat exchanger 11.

The diffuser 340 may be positioned further downstream of the flow path P than the trailing edge 212*b* of each of the plurality of blades 212. The diffuser 340 may be positioned behind the trailing edge 212*b* of each of the plurality of blades 212. The diffuser 340 may extend in the rear direction behind the trailing edge 212*b* of each of the plurality of blades 212. A front end of the diffuser 340 may be positioned behind the trailing edge 212*b* and the diffuser 340 may extend from the front end in the rear direction.

By the configuration, a flow of air may be guided by the bell mouth 330 until the air passes through the trailing edge 212*b* of the blade 212, and after the air passes through the trailing edge 212*b*, a flow of the air may be guided by the diffuser 340. Accordingly, pressure loss of air may be reduced, and blowing efficiency may be improved.

For example, the guide 300 may be coupled to the housing 100. More specifically, the guide 300 may include a housing coupling portion 350 provided at the inlet end 310, and the housing coupling portion 350 may be coupled to the front frame 110 of the housing 100. The housing coupling portion 350 may extend in a direction that is substantially parallel to a rear surface of the front frame 110.

The inlet end 310 of the guide 300 may have a shape and size substantially corresponding to the inlet 110*a* of the outdoor unit 10. The housing coupling portion 350 may be positioned along a circumference of the inlet 110*a* upon coupling to the front frame 110. The housing coupling portion 350 may be coupled to the front frame 110 by various methods such as screw-coupling, welding, etc.

By manufacturing the guide 300 separately from the front frame 110 and then coupling the guide 300 to the front frame 110 through the housing coupling portion 350, the guide 300 may be more easily manufactured although an extension length in front-rear direction of the guide 300 increases. Particularly, according to an embodiment of the disclosure, because the guide 300 covers an outer side of the trailing edge 212*b* of the blade 212, it may be required to manufacture the guide 300 having a long length in the front-rear direction. However, by manufacturing the guide 300 separately from the front frame 110, manufacturability may be improved and manufacturing cost may be reduced.

However, the guide 300 is not limited to this, and the guide 300 may be integrated into the front frame 110. For example, the guide 300 may be manufactured around the inlet 110*a* of the front frame 110 through press processing.

By the configuration, air flowing along the guide 300 may move efficiently toward the heat exchanger 11. Further, blowing efficiency of the blower fan 210 and heat-exchange efficiency between air and the heat exchanger 11 may be improved.

However, the above-described configuration of the guide 300 may be an example of a guide for guiding a flow of air in an outdoor unit of an air conditioner according to a concept of the disclosure, and a concept of the disclosure is not limited to this.

For example, a bell mouth of a guide may extend not directly from an inlet end of the guide. For example, a diffuser of the guide may extend not directly from an end of the bell mouth of the guide. For example, the guide may include a structure having a constant width between the bell mouth and the diffuser.

Figure 10:
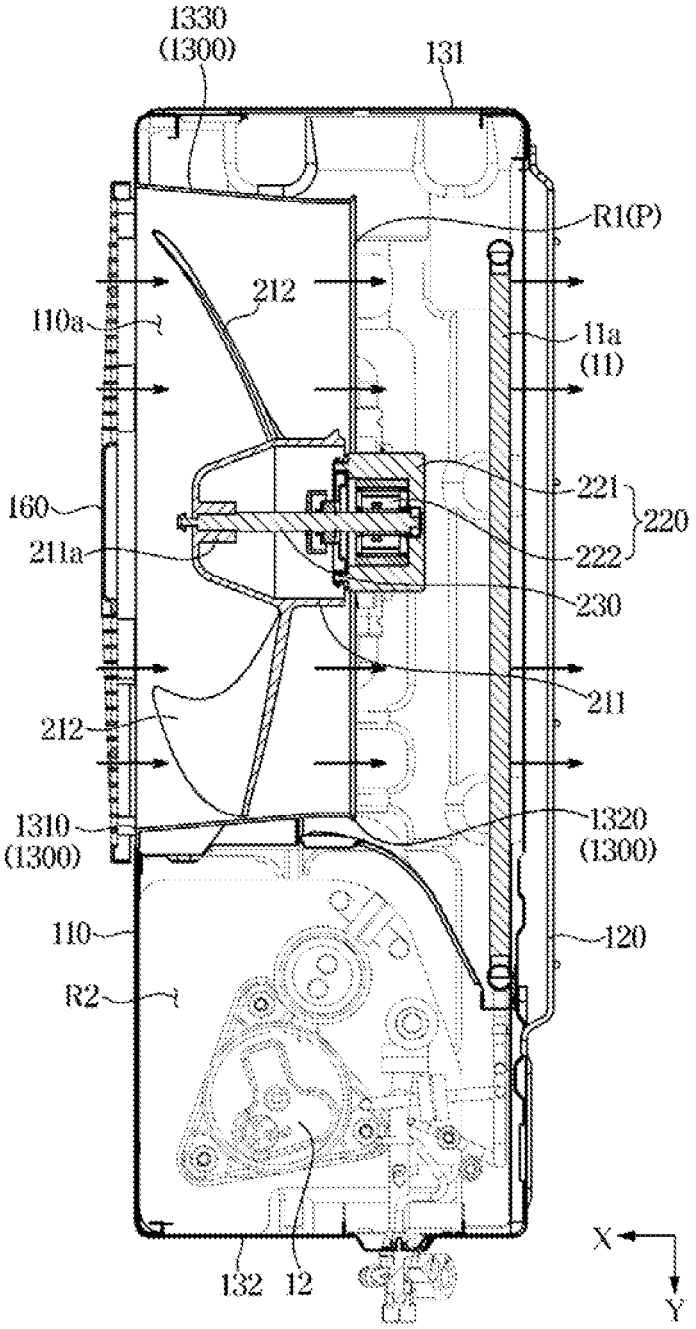
FIG. 10 is a cross-sectional view showing a state in which air flows in an outdoor unit of an air conditioner according to an embodiment of the disclosure.

FIG. 10 is a cross-sectional view showing a state in which air flows in an outdoor unit of an air conditioner according to an embodiment of the disclosure.

In the following description about an embodiment of FIG. 10, the same components as those described in the embodiments of FIGS. 1 to 9 may be assigned like reference numerals, and descriptions thereof will be omitted.

Referring to FIG. 10, the outdoor unit 10 of the air conditioner 1 according to an embodiment of the disclosure may include the heat exchanger 11 positioned along the outlet 120*b* of the rear frame 120.

The heat exchanger 11 may be positioned behind the blower fan 210. An entire of the heat exchanger 11 may extend along the left-right direction toward the Y direction.

That is, as shown in FIG. 10, the heat exchanger 11 may be configured with only the first portion 11*a*.

In this case, air flowing along the flow path P may need not to move toward the outlet 131*b* formed in the first side frame 131 for heat exchange. That is, air flowing along the flow path P may move from the front direction of the outdoor unit 10 in the rear direction, pass through the heat exchanger 11 and then be discharged through the outlet 120*b* of the rear frame 120.

The outdoor unit 10 of the air conditioner 1 may further include a guide 1300 for guiding air flowing along the flow path P. The guide 1300 may be formed along a circumference of the plurality of blades 212. The guide 1300 may cover the trailing edge 212*b* of each of the plurality of blades 212 from the outside.

The guide 1300 may include an inlet end 1310 through which air entered the inside of the housing 100 through the inlet 110*a* enters the guide 1300, and an outlet end 1320 through which air is discharged from the guide 1300.

The guide 1300 may extend from the inlet end 1310 to the outlet end 1320 in the front-rear direction of the outdoor unit 10.

The guide 1300 may include a bell mouth 1330. The bell mouth 1330 may extend from the inlet end 1310 up to the outlet end 1320. The bell mouth 1330 may be reduced in width from the inlet end 1310 toward the outlet end 1320. In other words, the bell mouth 1330 may be reduced in width from the upstream of the flow path P toward the downstream. In other words, the bell mouth 1330 may be reduced in width toward the rear direction of the outdoor unit 10.

Unlike the guide 300 of the embodiment shown in FIG. 9, the guide 1300 according to the embodiment of the disclosure as shown in FIG. 10 may include no diffuser.

Figure 11:
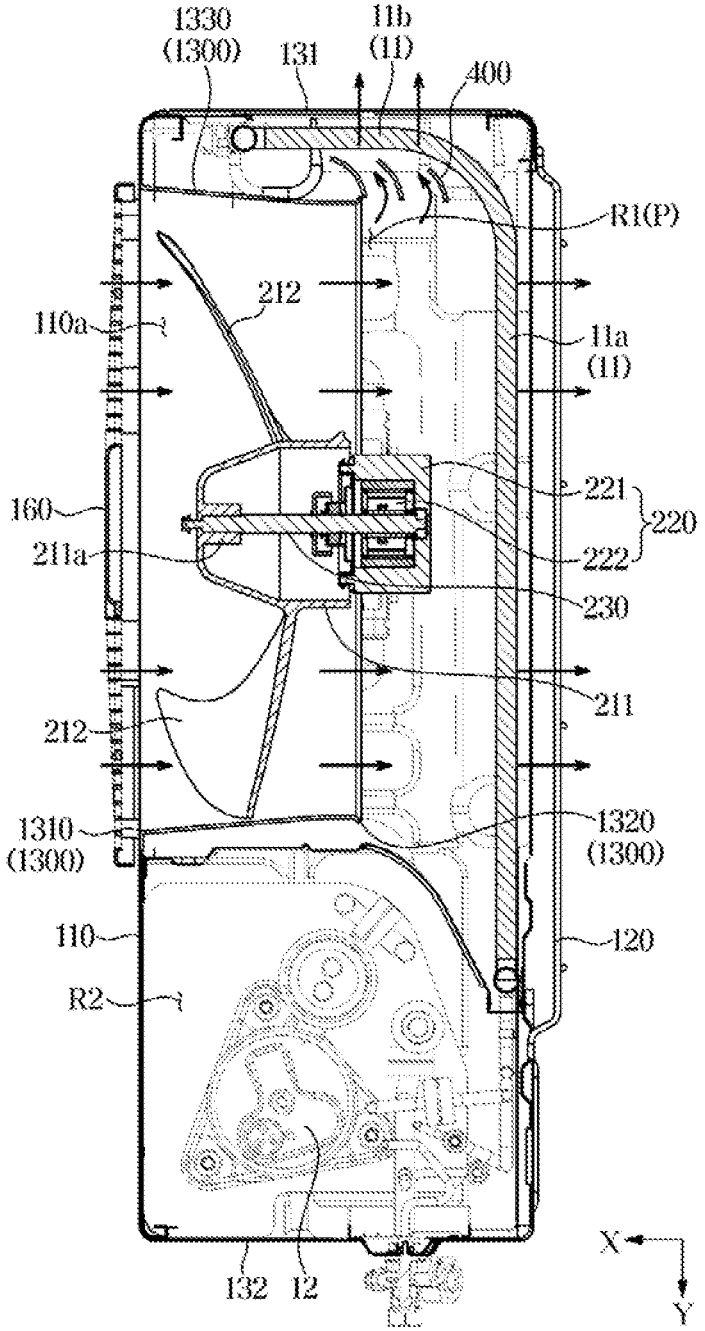
FIG. 11 is a cross-sectional view showing a state in which air flows in an outdoor unit of an air conditioner according to an embodiment of the disclosure.

FIG. 11 is a cross-sectional view showing a state in which air flows in an outdoor unit of an air conditioner according to an embodiment of the disclosure.

In the following description about an embodiment of FIG. 11, the same components as those described in the embodiments of FIGS. 1 to 9 may be assigned like reference numerals, and descriptions thereof will be omitted.

Referring to FIG. 11, the outdoor unit 11 of the air conditioner 1 according to an embodiment of the disclosure may include the heat exchanger 11 including both the first portion 11*a* and the second portion 11*b*. A configuration of the first portion 11*a* and the second portion 11*b* has been described above, and accordingly, descriptions thereof will be omitted.

The outdoor unit 10 of the air conditioner 1 according to an embodiment of the disclosure as shown in FIG. 11 may include the guide 1300 having a configuration corresponding to the guide 1300 according to an embodiment of the disclosure as shown in FIG. 10. The guide 1300 may include the bell mouth 1330 extending from the inlet end 1310 up to the outlet end 1320, and include no diffuser.

In this case, the outdoor unit 10 of the air conditioner 1 may include a slewing guide 400 such that air discharged from the guide 1300 through the outlet end 1320 reaches the second portion 11*b* of the heat exchanger 11.

The slewing guide 400 may cause at least one portion of air discharged from the outlet end 1320 to move to the second portion 11*b* of the heat exchanger 11 by slewing. The slewing guide 400 may be provided behind the outlet end 1330 of the guide 1300. The slewing guide 400 may extend from one end of the slewing guide 400, being adjacent to the outlet end 1330, toward another end of the slewing guide 400, being adjacent to the second portion 11*b* of the heat exchanger 11.

The slewing guide 400 may be supported by the base 140. The slewing guide 400 may extend from the base 140 upward in the Z direction. The slewing guide 400 may be in a shape of a curve, although not limited thereto.

A portion of air discharged through the outlet end 1320 of the guide 1300 may flow toward the first portion 11*a* of the heat exchanger 11, and another part of the air discharged through the outlet end 1320 may be guided by the slewing guide 400 and flow toward the second portion 11*b* of the heat exchanger 11.

By the configuration, air flowing along the guide 1300 may flow efficiently toward the first portion 11*a* and the second portion 11*b* of the heat exchanger 11. Furthermore, blowing efficiency of the blower fan 210 and heat-exchange efficiency between air and the heat exchanger 11 may be improved.

However, for example, the slewing guide 400 according to an embodiment of the disclosure as shown in FIG. 11 may be provided behind the guide 300 including both the bell mouth 330 and the diffuser 340, as in the embodiment of the disclosure shown in FIG. 9.

According to a concept of the disclosure, the outdoor unit of the air conditioner may receive air from the front direction of the outdoor unit by the shapes of the leading edges and trailing edges of the blades and the shapes of the blade surfaces between the leading edges and the trailing edges.

According to a concept of the disclosure, the guide of the outdoor unit of the air conditioner may cover the trailing edges of the blades from the outside to cause air to flow efficiently toward the heat exchanger.

According to a concept of the disclosure, the guide of the outdoor unit of the air conditioner may cause air to flow efficiently toward the heat exchanger by including the diffuser.

According to a concept of the disclosure, the outdoor unit of the air conditioner may cause air to flow efficiently toward the heat exchanger by including the slewing guide provided behind the outlet end of the guide.

Embodiments of the disclosure may provide an outdoor unit of an air conditioner including a housing; a flow path provided inside the housing; a heat exchanger positioned on the flow path; and a blower fan positioned upstream of the heat exchanger on the flow path and including a plurality of blades. Each of the plurality of blades may be inclined downstream of the flow path from a leading edge toward a trailing edge. Each of the plurality of blades may include an upstream surface facing an upstream direction of the flow path, and a downstream surface being opposite to the upstream surface and facing a downstream direction of the flow path. The upstream surface may include a convex surface that is convex toward the upstream direction of the flow path. The downstream surface may include a concave surface that is concave from the downstream direction of the flow path toward the upstream direction. The outdoor unit may further include a guide formed along a circumferential direction of the plurality of blades and configured to guide air flowing along the flow path. The guide may cover the trailing edge of each of the plurality of blades from outside. The leading edge may extend from one end positioned toward the guide to another end being opposite to the one end in a direction toward the downstream of the flow path P.

Embodiments of the disclosure may provide an outdoor unit of an air conditioner including an inlet formed in a front portion; an outlet positioned behind the inlet; a heat exchanger positioned between the inlet and the outlet; a blower fan positioned between the inlet and the heat exchanger; and a guide covering the blower fan from outside and configured to guide air flowing by the flow fan. The blower fan may include a hub connected to a rotating shaft and being rotatable about the rotating shaft, and a plurality of blades extending from the hub. Each of the plurality of blades may include a leading edge being an edge positioned at a side of a rotation direction of the hub, a trailing edge being an edge being opposite to the leading edge, and a blade surface extending from the leading edge to the trailing edge while being inclined in a rear direction. The guide may cover the trailing edge of each of the plurality of blades from the outside.

Effects according to the concepts of the disclosure are not limited to the above-mentioned effects, and other effects not mentioned will be clearly understood by one of ordinary skill in the technical field to which the disclosure belongs from the following descriptions.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. An outdoor unit of an air conditioner, comprising:

a housing including an inlet and an outlet, wherein a flow path is formed between the inlet and the outlet inside the housing;

a heat exchanger inside the housing; and a blower fan inside the housing between the inlet and the heat exchanger so that the inlet is forward of the blower fan in the flow path, and configured to flow air along the flow path, from the inlet, through the heat exchanger, and toward the outlet, wherein the blower fan includes:

a rotating shaft, a hub configured to be rotatable about the rotating shaft, and a plurality of blades extending from the hub and arranged along a circumference of the hub, each blade among the plurality of blades includes:

an inner end connected to an outer circumferential surface of the hub, an outer end at an outer edge in a direction in which each blade extends from the hub, a leading edge at a first side of facing a blade facing a rotation direction of the hub, the leading edge extending in a direction away from the rotating shaft, from a first end of the inner end in the rotation direction of the hub to a first end of the outer end in the rotation direction of the hub, a trailing edge at a second side of the blade opposite to the first side of the blade, the trailing edge extending in a direction away from the rotating shaft, from a second end of the inner end opposite to the first end of the inner end to a second end of the outer end opposite to the first end of the outer end, and a blade surface between the leading edge and the trailing edge and inclined toward the inlet from the trailing edge to the leading edge so that a distance between the leading edge and the inlet is smaller than a distance between the trailing edge and the inlet, wherein a distance between the first end of the inner end and the inlet is smaller than a distance between the second end of the inner end and the inlet, and wherein a distance between the first end of the outer end and the inlet is smaller than a distance between the second end of the outer end and the inlet.

2. The outdoor unit of claim 1, wherein the leading edge includes:

a first end connected to the hub, and a second end opposite to the first end, and the second end is closer than the first end to the inlet.

3. The outdoor unit of claim 1, wherein the heat exchanger is positioned adjacent to the outlet, and each blade among the plurality of blades is positioned such that the trailing edge is closer than the leading edge to at least one portion of the heat exchanger.

4. The outdoor unit of claim 1, further comprising:

a guide positioned along a circumferential direction of the plurality of blades and configured to guide air flowing along the flow path, wherein the guide covers the trailing edge of each blade among the plurality of blades from outside in a radial direction of the hub.

5. The outdoor unit of claim 4, wherein the guide extends from the inlet toward the heat exchanger, up to the trailing edge of each blade among the plurality of blades.

6. The outdoor unit of claim 4, wherein the guide includes:

an inlet end through which air enters the guide, an outlet end through which air is discharged from the guide, and a bell mouth extending from the inlet end toward the outlet end, and the bell mouth is reduced in width from the inlet end toward the outlet end.

7. The outdoor unit of claim 6, wherein the bell mouth covers an outer end of the trailing edge of each blade among the plurality of blades in the radial direction of the hub.

8. The outdoor unit of claim 7, wherein the guide includes:

a diffuser extending from the outlet end toward the bell mouth, and the diffuser increases in width toward the outlet end.

9. The outdoor unit of claim 8, wherein the heat exchanger includes:

a first portion facing the outlet end, and a second portion bent from one end of the first portion and extending in a longitudinal direction of the guide, and the diffuser is configured to move at least a portion of air flowing along the outlet end toward the second portion.

10. The outdoor unit of claim 6, wherein the inlet end and the outlet end are disposed to face each other in a longitudinal direction of the rotating shaft.

11. The outdoor unit of claim 6, wherein the heat exchanger includes:

a first portion facing the outlet end, and a second portion bent from one end of the first portion and extending in a direction toward the inlet, and the outdoor unit further comprises:

a slewing guide configured to cause at least a portion of air discharged from the outlet end to flow to the second portion by slewing.

12. The outdoor unit of claim 1, wherein the blade surface includes:

an upstream surface facing an upstream direction of the flow path, and a downstream surface being opposite to the upstream surface and facing a downstream direction of the flow path, the upstream surface includes a convex surface that is convex toward the upstream direction of the flow path, and the downstream surface includes a concave surface that is concave toward the upstream direction of the flow path.

13. The outdoor unit of claim 12, wherein the concave surface extends in a direction from the trailing edge of the blade toward the leading edge, and the concave surface is formed with a smaller inclination at the trailing edge than at the leading edge with respect to a direction of the flow path.

14. The outdoor unit of claim 1, wherein the leading edge is inclined at an angle of inclination with respect to a radial direction of the hub, and the angle of inclination of the leading edge is greater than an angle of inclination of the trailing edge which is inclined with respect to the radial direction of the hub.

15. The outdoor unit of claim 1, wherein an extension length of the leading edge along a radial direction of the hub is longer than an extension length of the trailing edge along the radial direction of the hub.

16. An outdoor unit of an air conditioner, comprising:

a housing including an inlet and an outlet, wherein a flow path is formed between the inlet and the outlet inside the housing;

a heat exchanger inside the housing; and a blower fan inside the housing between the inlet and the heat exchanger, and configured to flow air along the flow path, from the inlet, through the heat exchanger, and toward the outlet, wherein the blower fan includes:

a rotating shaft, a hub configured to be rotatable about the rotating shaft, and a plurality of blades extending from the hub and arranged along a circumference of the hub, and each blade among the plurality of blades includes:

an inner end connected to an outer circumferential surface of the hub;

an outer end at an outer edge in a direction which each blade extends from the hub, a leading edge at a first side of a blade facing a rotation direction of the hub, the leading edge extending in a direction away from the rotating shaft, from a first end of the inner end in the rotation direction of the hub to a first end of the outer end in the rotation direction of the hub, a trailing edge at a second side of the blade opposite to the first side of the blade, the trailing edge extending in a direction away from the rotating shaft, from a second end of the inner end opposite to the first end of the inner end to a second end of the outer end opposite to the first end of the outer end, and a blade surface between the leading edge and the trailing edge and inclined toward the inlet from the trailing edge to the leading edge, wherein a distance between the first end of the inner end and the inlet is smaller than a distance between the second end of the inner end and the inlet, wherein a distance between the first end of the outer end and the inlet is smaller than a distance between the second end of the outer end and the inlet, and wherein the leading edge is inclined at an angle of inclination of an extension direction of the leading edge with respect to a radial direction of the hub, and the angle of inclination of the leading edge is greater than an angle of inclination of an extension direction of the trailing edge which is inclined with respect to the radial direction of the hub.

17. An outdoor unit of an air conditioner, comprising:

a housing including an inlet and an outlet, wherein a flow path is formed between the inlet and the outlet inside the housing;

a heat exchanger inside the housing; and a blower fan inside the housing between the inlet and the heat exchanger, and configured to flow air along the flow path, from the inlet, through the heat exchanger, and toward the outlet, wherein the blower fan includes:

a rotating shaft, a hub configured to be rotatable about the rotating shaft, and a plurality of blades extending from the hub and arranged along a circumference of the hub, and each blade among the plurality of blades includes:

an inner end connected to an outer circumferential surface of the hub, an outer end at an outer edge in a direction which each blade extends from the hub, a leading edge at a first side of a rotation direction facing a rotation direction of the hub, the leading edge extending in a direction away from the rotating shaft, from a first end of the inner end in the rotation direction of the hub to a first end of the outer end in the rotation direction of the hub, a trailing edge, at a second side of a blade opposite to the first side of the blade, the trailing edge extending in a direction away from the rotating shaft, from a second end of the inner end opposite to the first end of the inner end to a second end of the outer end opposite to the first end of the outer end, and a blade surface between the leading edge and the trailing edge and inclined toward the inlet from the trailing edge to the leading edge, wherein a distance between the first end of the inner end and the inlet is smaller than a distance between the second end of the inner end and the inlet, wherein a distance between the first end of the outer end and the inlet is smaller than a distance between the second end of the outer end and the inlet, and wherein an extension length of the leading edge along a radial direction of the hub is longer than an extension length of the trailing edge along the radial direction of the hub.

* * * * *